US005577559A

United States Patent [19]

Voll et al.

[11] Patent Number: 5,577,559

[45] Date of Patent: Nov. 26, 1996

[54] HIGH-RATE MULTIZONE GRAVEL PACK SYSTEM

[75] Inventors: Benn A. Voll, Houston, Tex.; Wilfred Schexnayder, Jr., Lafayette, La.

[73] Assignee: Baker Hughes Incorporated, Houston, Tex.

[21] Appl. No.: 402,187

[22] Filed: Mar. 10, 1995

[51] Int. Cl.[6] ..... E21B 43/04

[52] U.S. Cl. ..... 166/278; 166/51; 166/143

[58] Field of Search ..... 166/278, 145, 166/316, 322, 51

[56] References Cited

U.S. PATENT DOCUMENTS

| | | | |
|---|---|---|---|
| 3,987,854 | 10/1976 | Callihan et al. | 166/51 X |
| 4,044,832 | 8/1977 | Richard et al. | 166/51 X |
| 4,428,428 | 1/1984 | Smyrl et al. | 166/51 X |
| 4,522,264 | 6/1985 | McNeer | 166/51 X |
| 4,606,408 | 8/1986 | Zunkel et al. | 166/51 X |
| 4,635,725 | 1/1987 | Burroughs | 166/51 X |
| 5,332,038 | 7/1994 | Tapp et al. | 166/278 |
| 5,443,117 | 8/1995 | Ross | 166/51 |

*Primary Examiner*—Frank Tsay
*Attorney, Agent, or Firm*—Rosenblatt & Redano P.C.

[57] ABSTRACT

A High-Rate Multizone Gravel Pack System is provided that allows significantly higher gravel packing flow rates than were previously available. This system includes a fluid bypass which greatly enhances flow rate and decreases damage to the bypass due to erosion. The system is employed in a multi-stage arrangement which allows the gravel-packing of multiple production zones with a single trip into the well bore. A memory gauge sensing wash pipe pressure and temperature is incorporated to allow for data acquisition during the gravel packing process.

43 Claims, 22 Drawing Sheets

HIGH-RATE MULTIZONE GRAVEL PACK SYSTEM

FIELD OF THE INVENTION

The field of the invention is circulating fluids and gavel packing formations in well bores.

BACKGROUND OF THE INVENTION

Gravel packing of a well is a recognized technique for preparing a formation for production and for improving a well's production characteristics. Gravel packing is generally carried out by pumping gravel-containing fluid down into the zone of the formation to be treated and filtering the returning fluid to insure that the gravel is deposited in the desired zone. The goal of gravel packing is to force gravel out of the well casing and into the producing formation. However, the gravel-containing fluid must be pumped through the interior of the down hole equipment string to prevent losses and contamination between the surface and the desired zone. At some point, it is necessary to use a bypass tool to switch the flow of gravel-containing fluid from the interior of the equipment string to the exterior of the string so that the fluid may be used to gravel pack the formation. The bypass tool must direct the downward-traveling fluid outward, and simultaneously direct the upward-traveling return fluid from the interior of the equipment string to the exterior for the return trip to the surface.

Current bypass tools restrict the maximum rate of flow to about fifteen barrels per minute. This restriction is caused by the fluid pathway used to exchange the positions of the fluid streams. The downward-flowing path requires a series of sharp tums which causes flow rate losses and subjects the tool to relatively high rates of erosion. This series of tums usually entails at least four right-angle tums to redirect the gravel bearing fluid from the tool's interior to its exterior. Because of this flow rate restriction, the pressure that can be used to gravel pack a formation is restricted. However, it is desirable in some cases to provide a gravel packing flow rate in excess of twenty barrels per minute or more to maintain higher gravel packing pressures. These higher pressures would allow gravel to be forced further into formation fractures, improving well production rates.

It is therefore desirable to have a bypass tool that allows higher flow rates, and accordingly higher treatment pressures, than present tools. This goal is accomplished by providing a tool which utilizes enlarged flow areas and direct exit ports to direct the flow of downward-traveling fluid from the interior to the exterior of the tool. In this way, the fluid is required to alter course only twice, rather than the usual four tums required by current bypass tools. Further, the amount of course alteration required by the slanted exit ports is substantially less than ninety degrees:, resulting in greatly lessened flow rate losses compared to current bypass tools. The lower velocities for a given flow rate have the additional advantage of lessening erosion of the bypass tool.

A retrievable memory gauge is also provided to read pressure and temperature data during gravel packing. This gauge is designed to collect data without being disturbed by the fluid flow passing through the ports above the gauge.

A High-Rate Multizone Gravel Pack System is provided that allows significantly higher gravel packing flow rates for a tool of a given size than were previously available. This system includes a fluid bypass which greatly enhances flow rate and decreases damage to the bypass due to erosion compared to current tools. The system can be employed in a multi-stage arrangement which allows the gavel-packing of multiple production zones with a single trip into the well bore.

It is a goal of this invention to provide a bypass tool that incurs lower fluid pressure losses compared to present bypass tools.

It is a further goal of this invention to provide a bypass tool that allows higher gravel packing flow rates at a formation than are allowed by present bypass tools.

It is another goal of this invention to provide a bypass tool that is less subject to erosion than present bypass tools.

It is another goal of this invention to provide a multi-zone gravel packing system that allows gravel packing at high flow rates in multiple production zones with a single trip of the apparatus into the well bore.

It is another goal of this invention to provide a retrievable memory gauge capable of sensing and recording pressure and temperature during gravel packing without being disturbed by the fluid flow through the bypass tool.

DETAILED DESCRIPTION OF THE PREFERRED EMBODIMENT

Figure 1A:
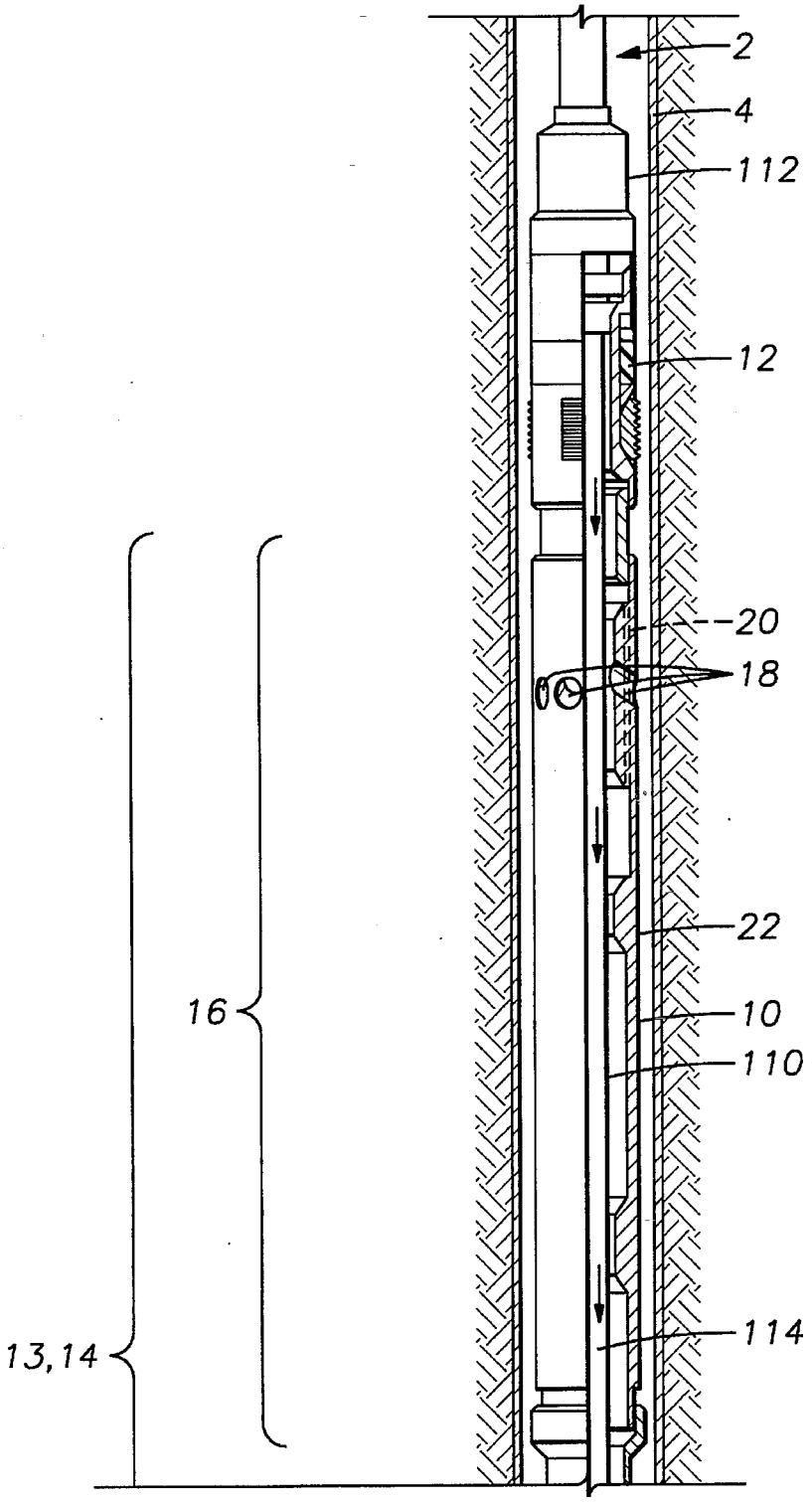
FIG. 1A–D is a partially cut away drawing of the High-Rate Multizone Gravel Pack System, showing the system in position to wash down a well bore.
Figure 1B:
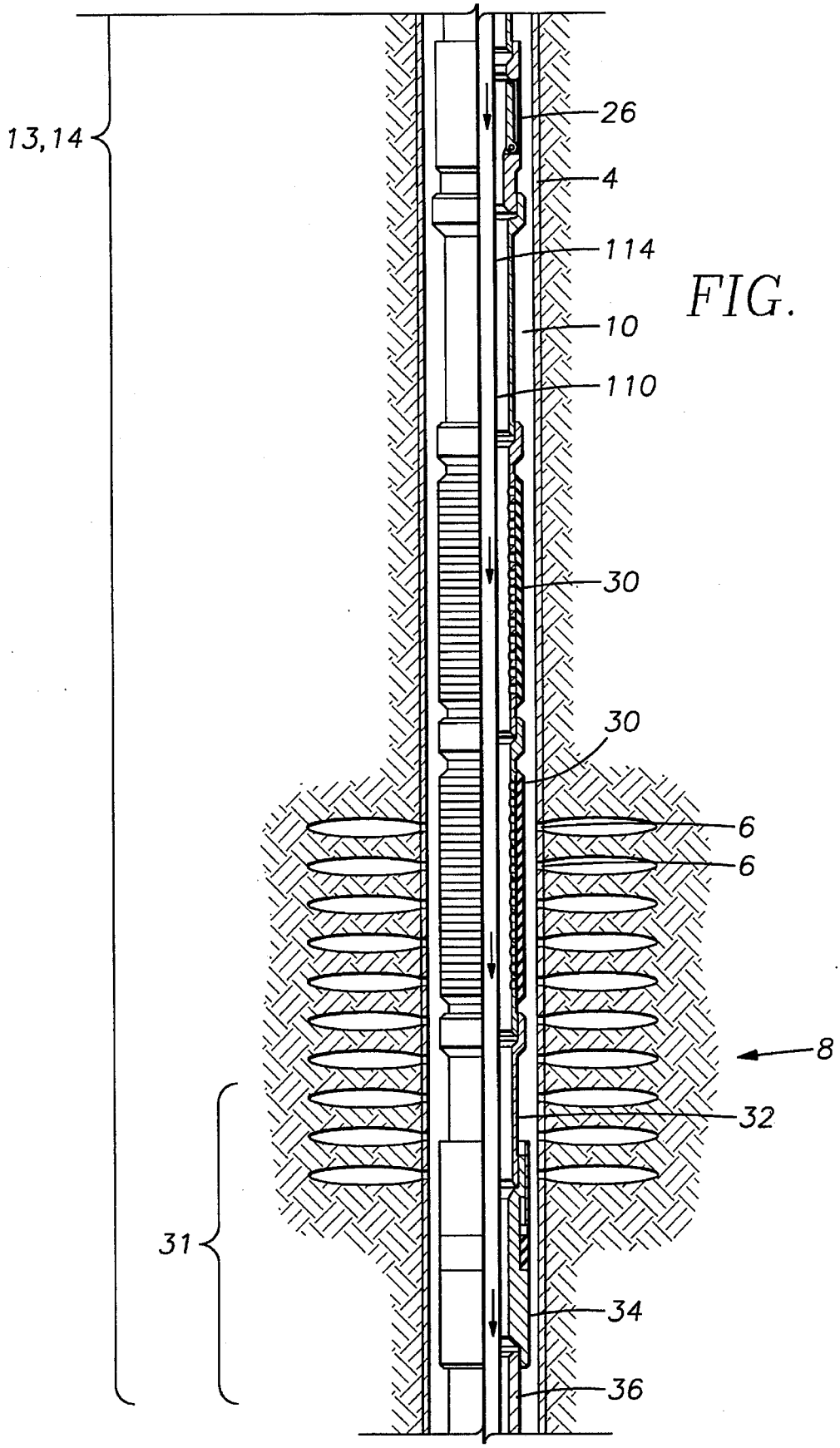
Figure 1C:
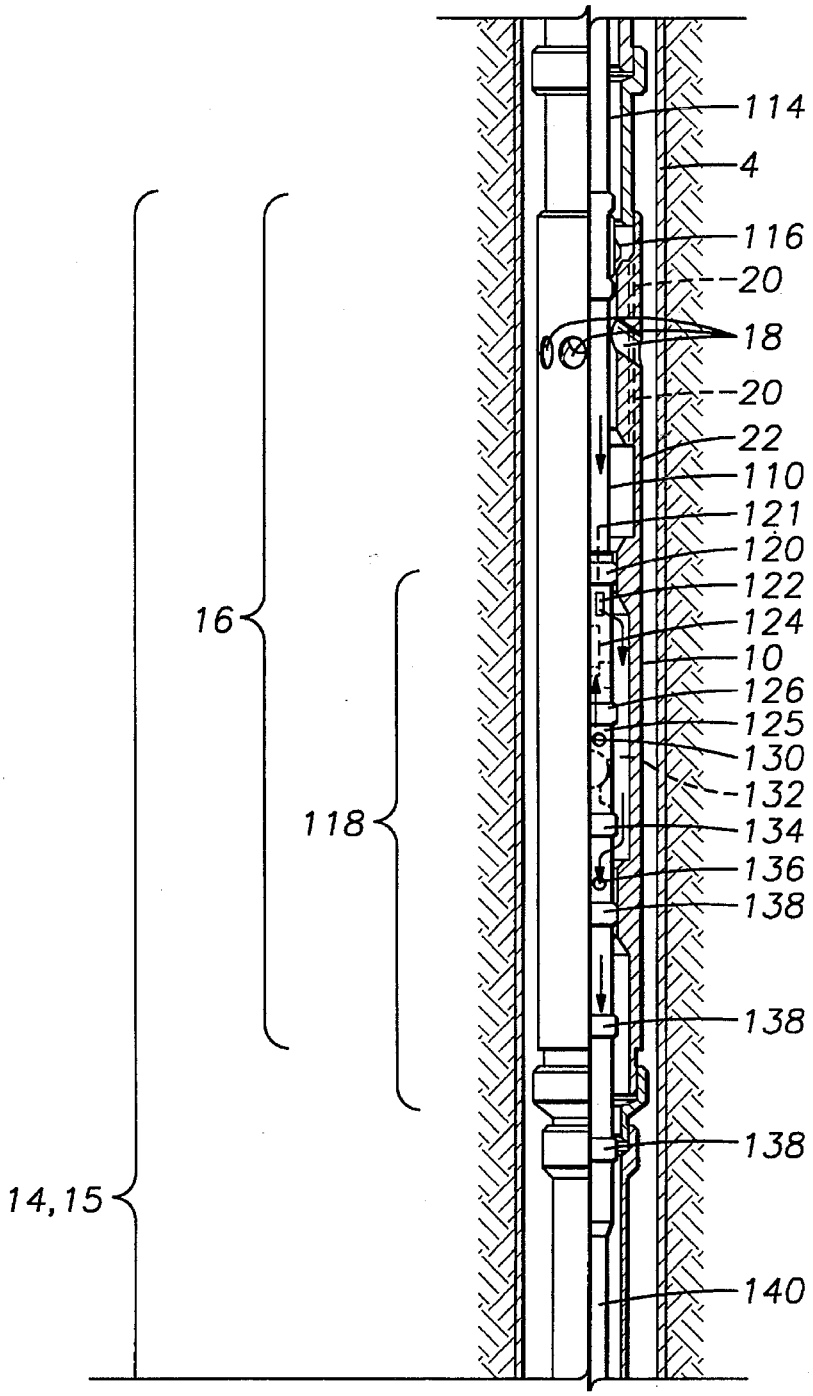
Figure 1D:
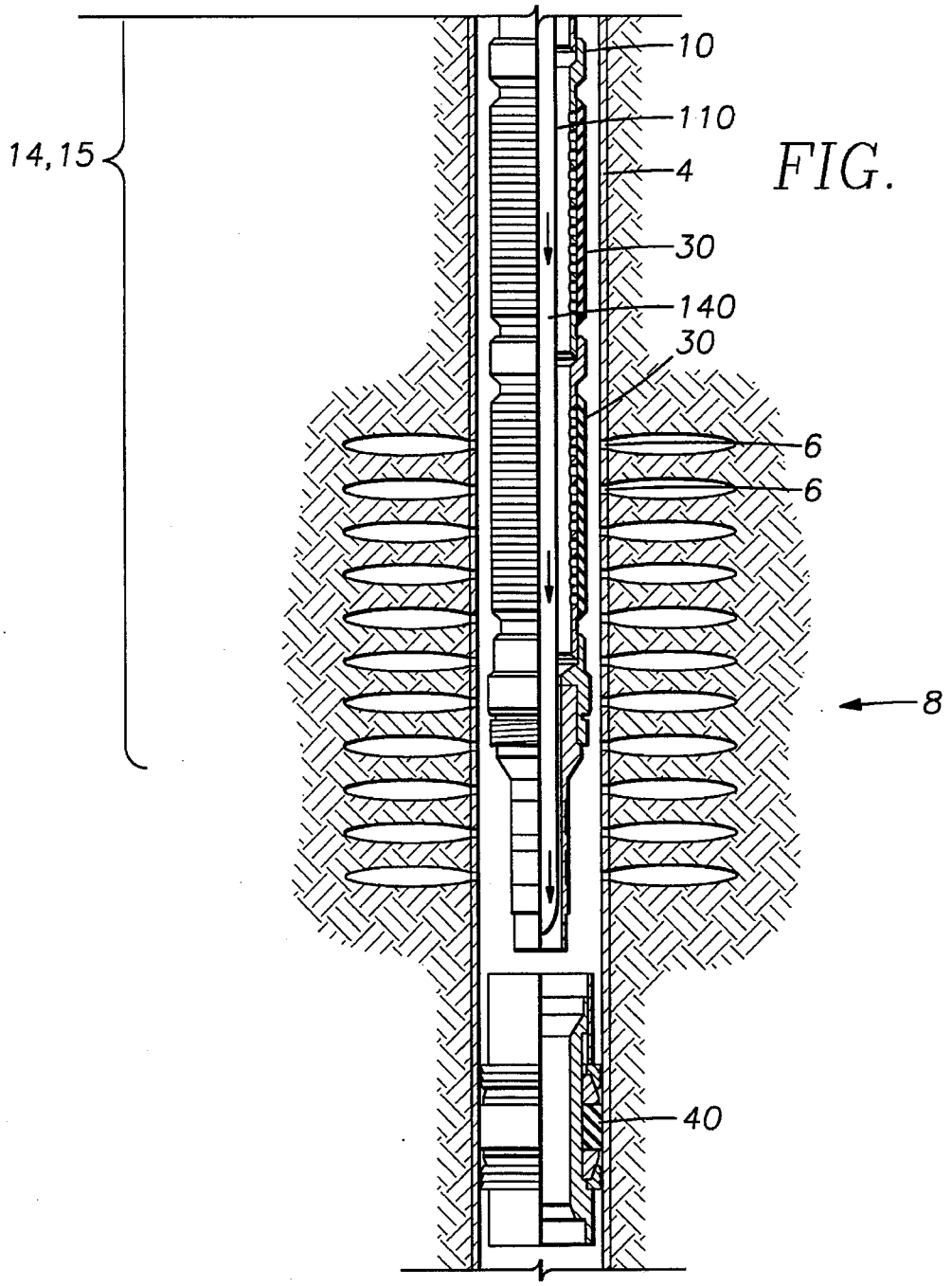

Referring to FIG. 1A–D, one embodiment of the High-Rate Multizone Gravel Pack System is shown. The High-Rate Multizone Gravel Pack System comprises an outer equipment string 10 and an inner equipment string 110. The outer equipment string 10 comprises an upper packer 12, such as Baker Model 'SC-9' (Product No. 488-20), circulation stages 14, such as Baker S-22B Anchor Latch Seal Assembly, and a sump packer 40, such as Baker Model 'D' (Product No. 415-13).

The High-Rate Multizone Gravel Pack System may have multiple circulation stages 14 in the outer equipment string 10 as shown in FIG. 1A–D. Each circulation stage 14 comprises an external bypass subassembly 16, such as Baker Product No. 469-10, and pre-pack screens 30, such as Baker Product No. 486-19. Each circulation stage 14 except for the bottom-most circulation stage 15 also comprises an isolation package 31. The isolation package 31 comprises an upper seal bore 32, such as Baker Product No. 485-34, an isolation packer 34, such as Baker Product No.488-03, and a lower seal bore 36, such as Baker Product No. 485-34. Additionally, the upper-most circulation stage 13 comprises a knock out isolation valve 26, such as Baker Product No. 487-35.

The inner equipment string 110 comprises a setting tool 112, such as Baker Model 'SC' (Product No. 445-21), an upper wash pipe 114, an indicating collet 116, such as Baker Model 'A' (Product No. 445-34), an internal bypass subassembly 118, and a lower wash pipe 140.

Figure 2A:
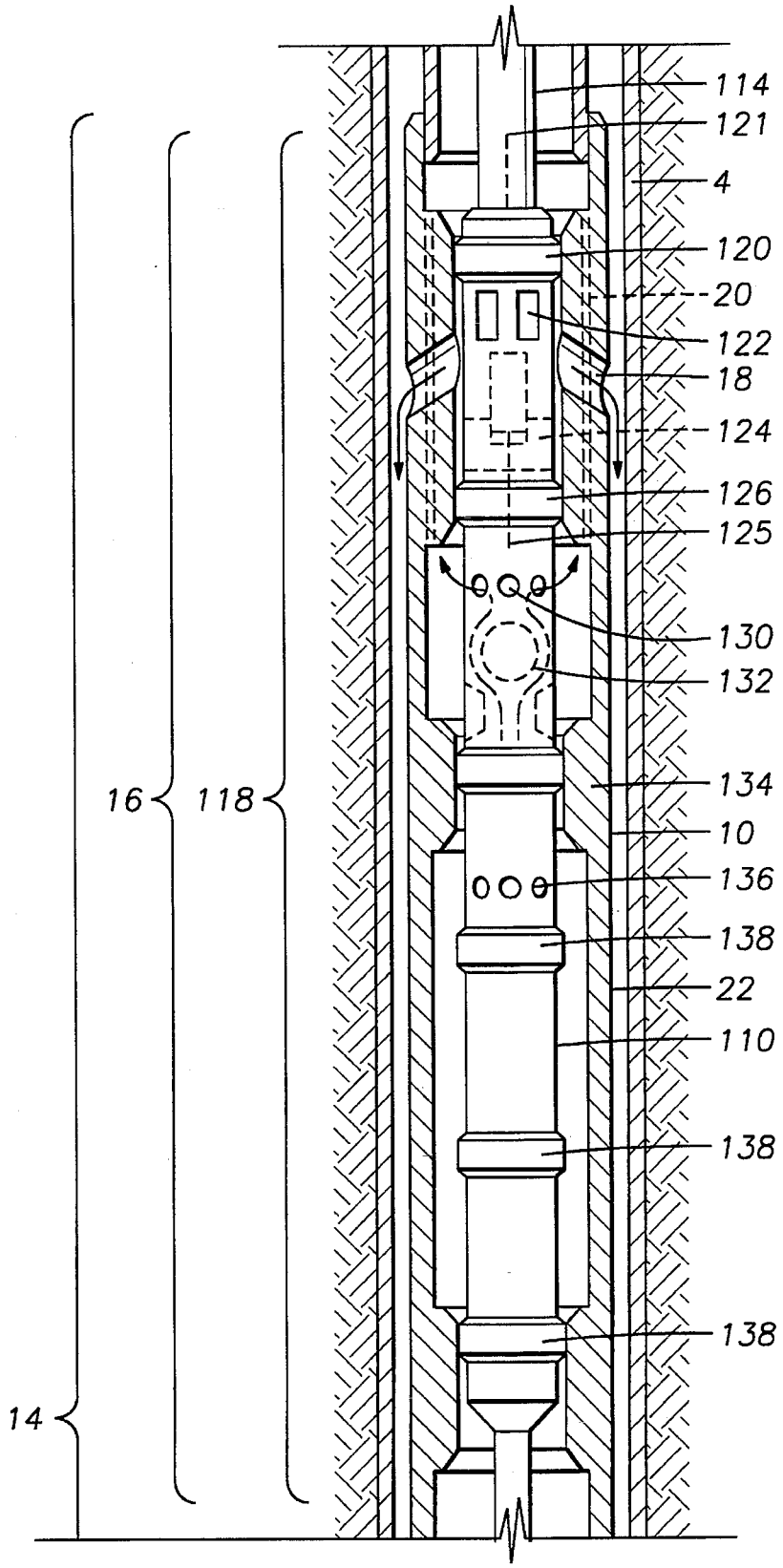
FIG. 2A is a cut away side view of the external and internal bypass subassemblies showing flow paths in the circulating, or gravel packing, mode.

Referring to FIG. 2A, the external bypass subassembly 16 and internal bypass subassembly 118 are shown in detail. The external bypass subassembly 16 comprises high-rate exit ports 18, return channels 20, and a bypass extension 22. The internal bypass subassembly 118 comprises a first seal ring 120, an inner fluid pathway 121, first outlet ports 122, a memory gauge/landing assembly 124, a probe 125, a second seal ring 126, second outlet ports 130, a low bottom hole pressure check valve 132, a third seal ring 134, bypass 136, and lower seal rings 138.

This preferred embodiment provides a large improvement over the prior art in cross-sectional area of the inner fluid pathway and accordingly allows much lower flow velocities. For example, a prior art bypass tool with a four-inch outside diameter ("OD") has an inner fluid pathway with a cross-sectional area of 1.77 square inches, or approximately 14% of the total cross-sectional area (12.56 square inches) of the inner bypass subassembly. The configuration of the present invention for a four-inch OD tool allows an inner fluid pathway with a cross-sectional area of 7.07 square inches, or approximately 56% of the cross-sectional area of the inner bypass subassembly. The following table shows comparisons of prior art tools of several OD sizes with the same-sized inner bypass subassemblies of the invention:

| Tool OD | Tool XSA | Prior art XSA | Prior art % | New XSA | New % |
|---|---|---|---|---|---|
| 4 | 12.56 | 1.77 | 14 | 7.07 | 56 |
| 4.75 | 17.72 | 2.75 | 16 | 7.07 | 40 |
| 6 | 28.27 | 4.01 | 14 | 18.65 | 66 |

In the above table, internal bypass subassembly OD's are stated in inches, XSA stands for "cross-sectional area," cross-sectional areas are stated in square inches, the percentages are calculated by dividing the number in the corresponding "XSA" column by the corresponding number in the "Tool XSA" column, and the columns "New XSA" and "New %" represent values for bypass tools of the present invention.

Figure 2B:
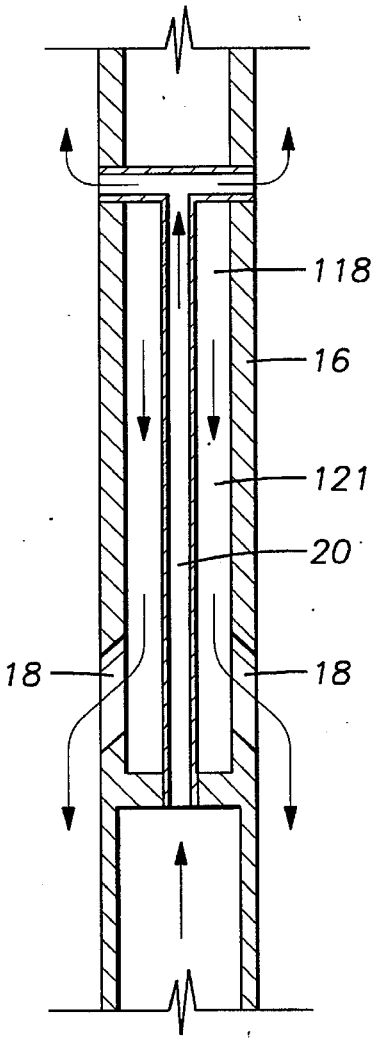
FIG. 2B is a cut away side view of an additional embodiment of the external and internal bypass subassemblies showing flow paths in the circulating, or gravel packing, mode.

An alternative configuration of the present invention is shown in FIG. 2B. This configuration provides an external bypass subassembly 16, an internal bypass subassembly 118, inner fluid pathway 121, high rate exit ports 18, and return channels 20. Because the return channels 20 are not located in the external bypass subassembly 16, the cross-sectional area of the inner fluid pathway 121 is not as large as in the preferred embodiment described above. However, this configuration would be useful when working with formations where there are large fluid losses into the formation, while still providing a large improvement in flow velocity over the prior art. Unless there are large fluid losses into the formation, this configuration would experience increased backpressure.

Figure 2C:
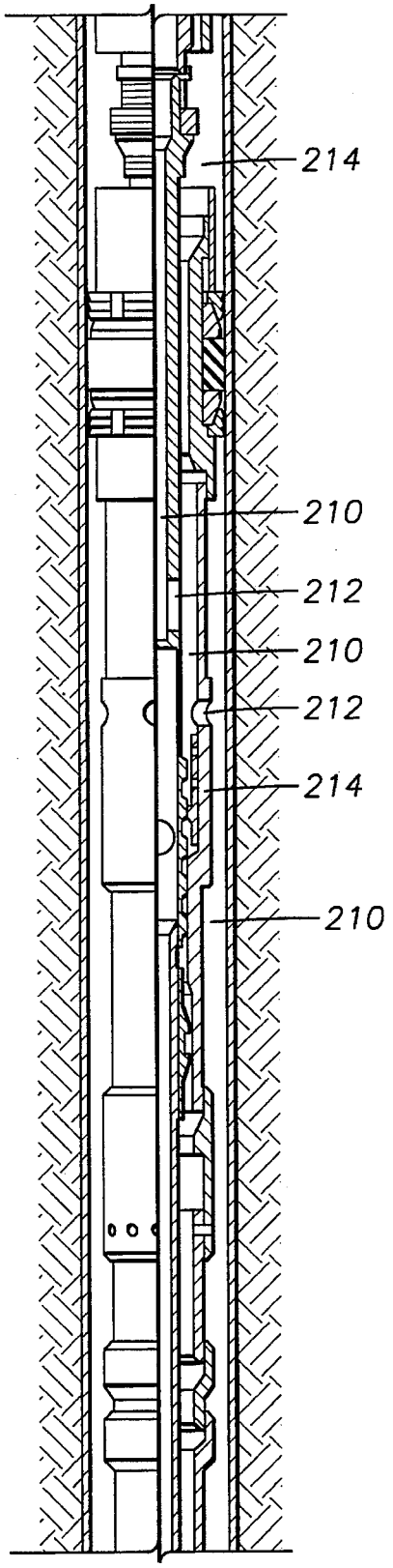
FIG. 2C is a diagram of a prior art bypass tool, showing flow paths required to redirect flow from the interior to the exterior of the tool.
Figure 3A:
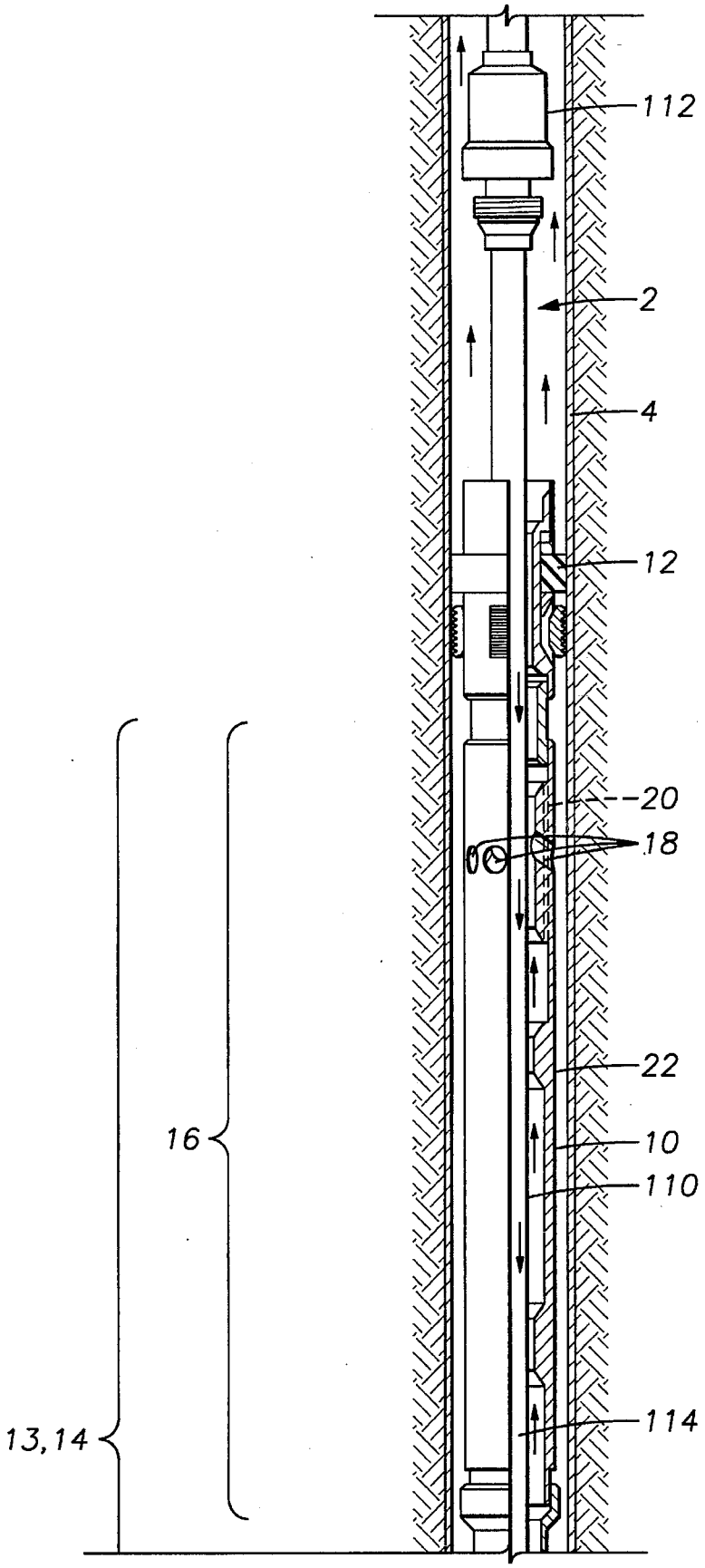
FIG. 3A–D is a partially cut away drawing of the High-Rate Multizone Gravel Pack System, showing the system in position to gravel pack a bottom zone.
Figure 3B:
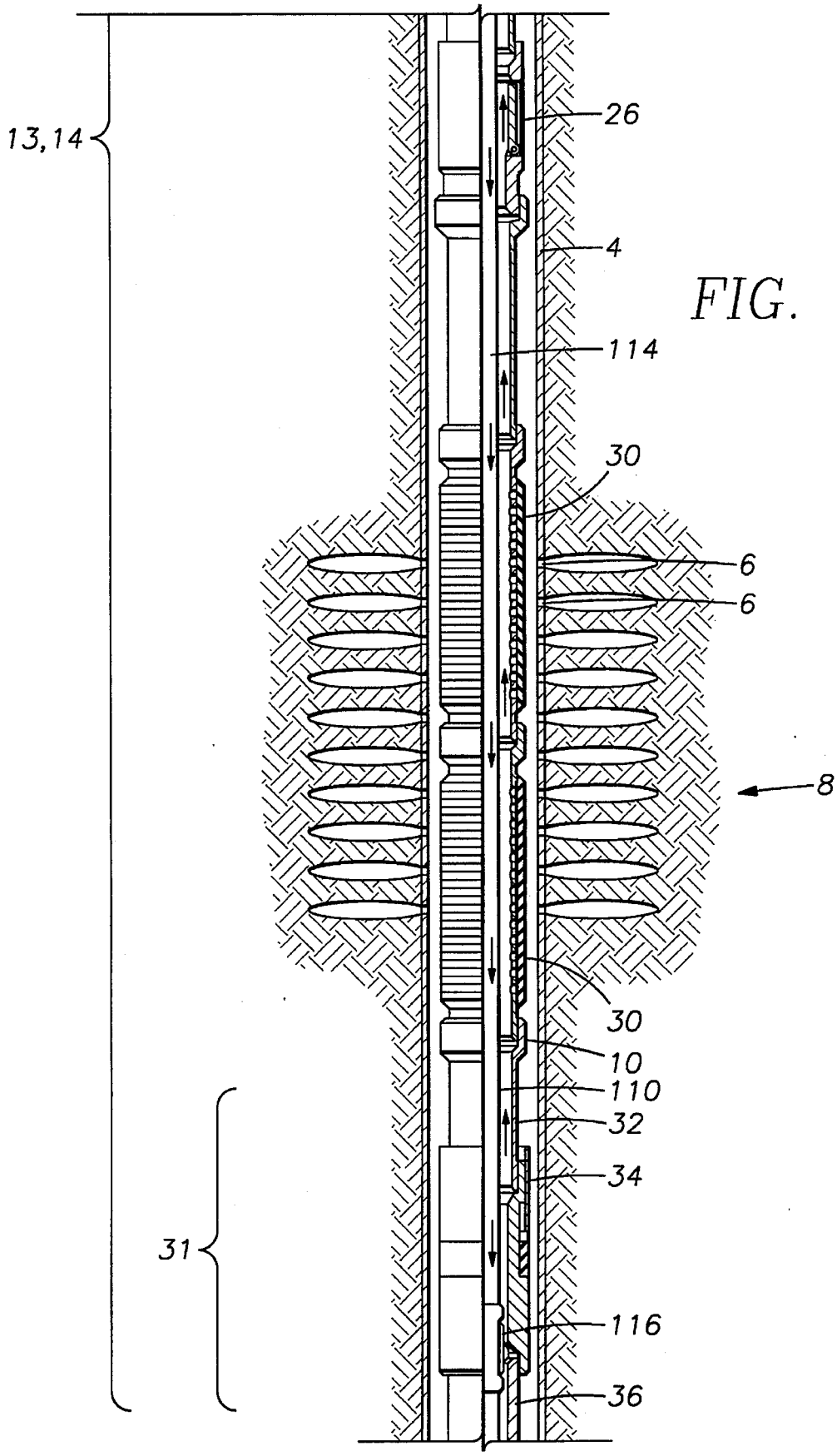
Figure 3C:
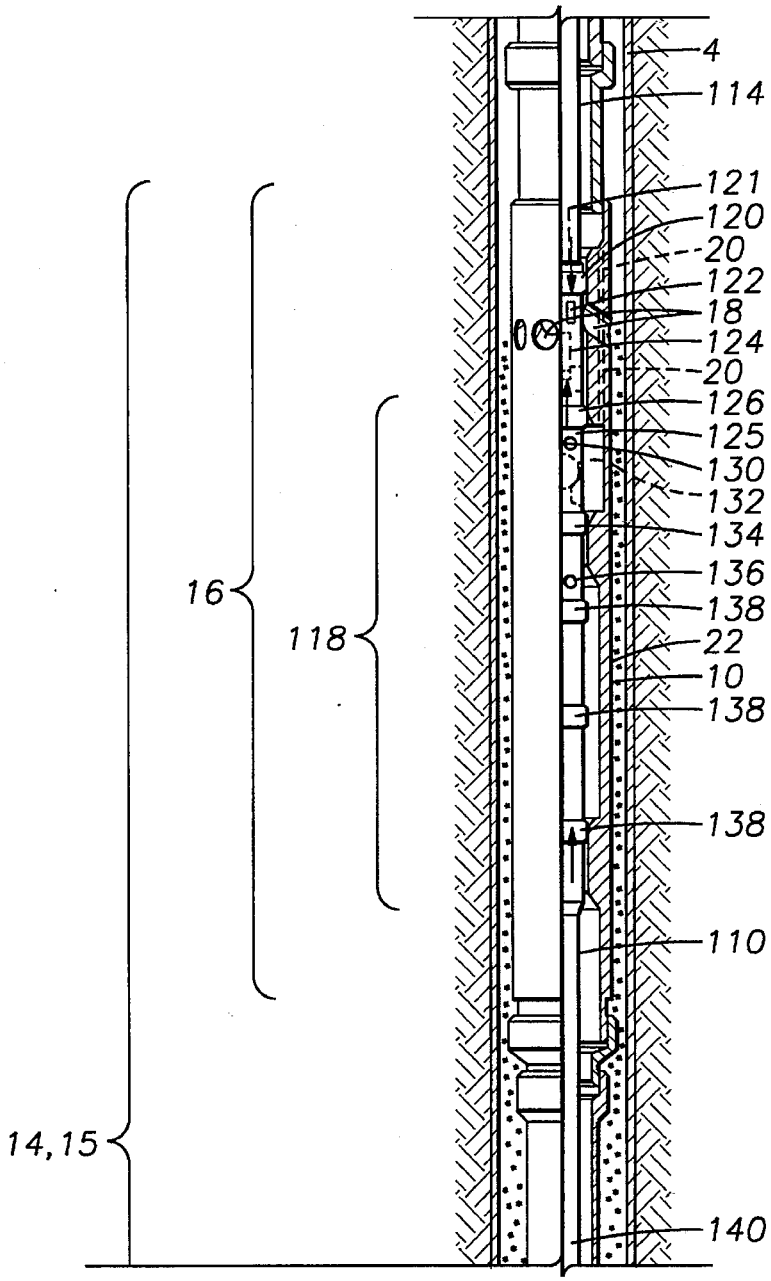
Figure 3D:
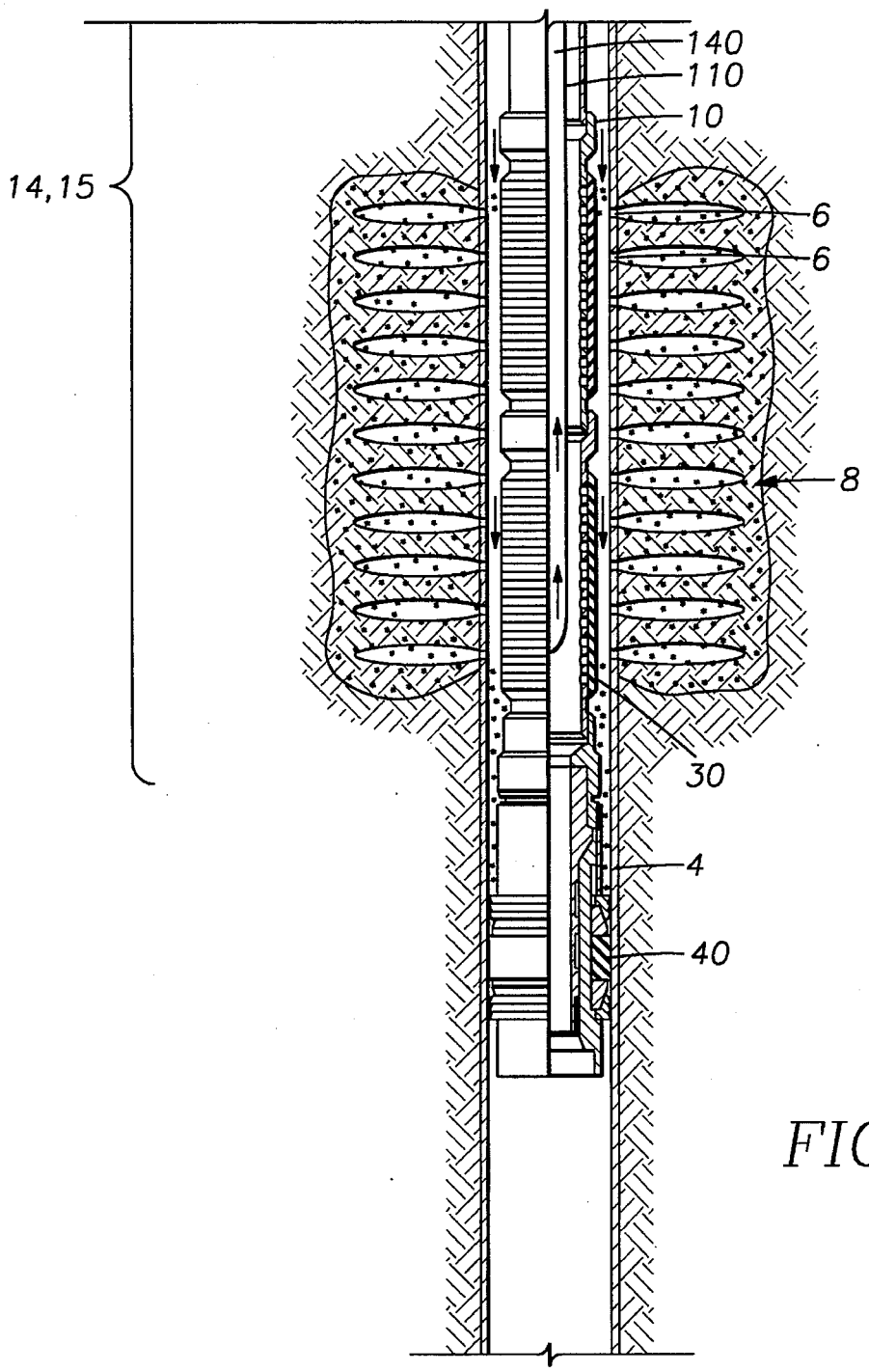
Figure 4A:
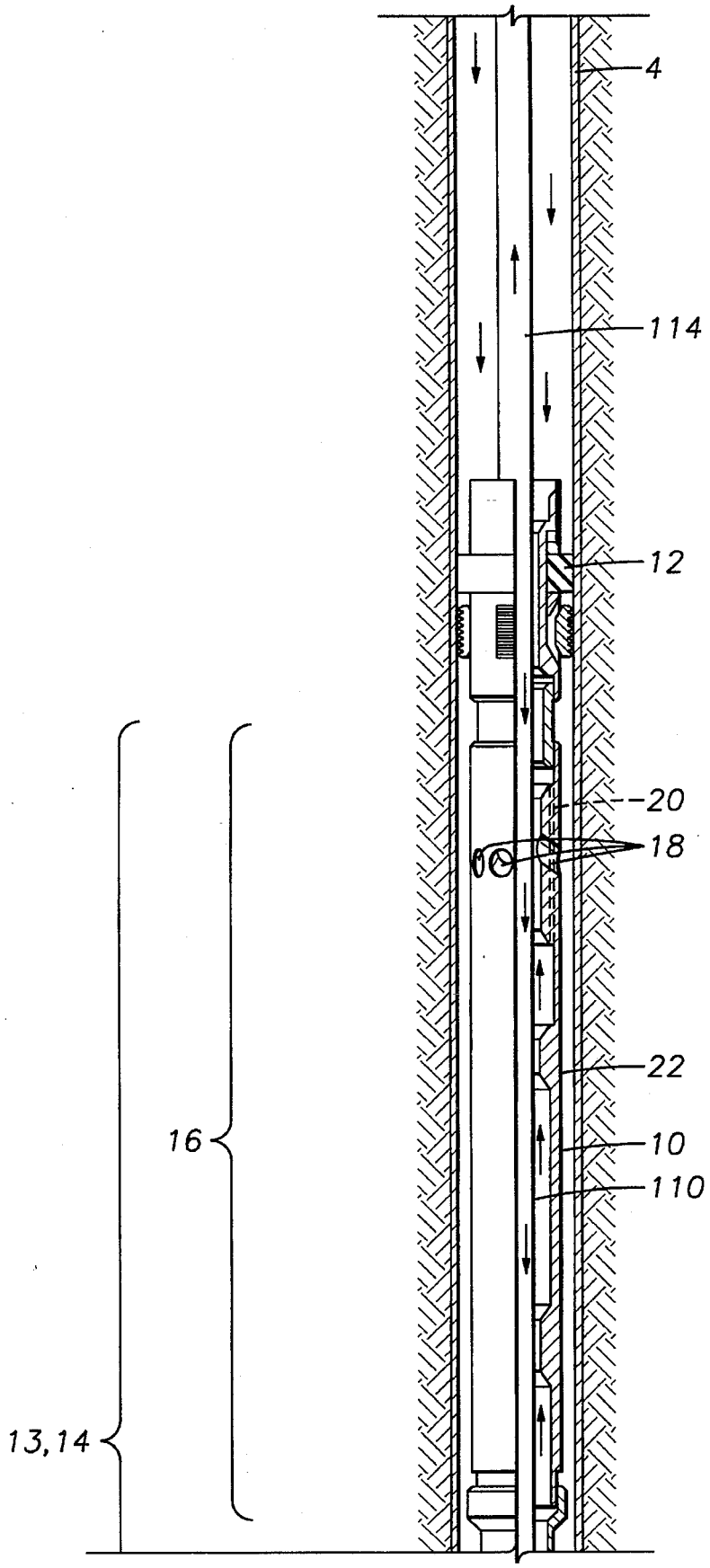
FIG. 4A–D is a partially cut away drawing of the High-Rate Multizone Gravel Pack System, showing the system in position to reverse flow after gravel packing a bottom zone.
Figure 4B:
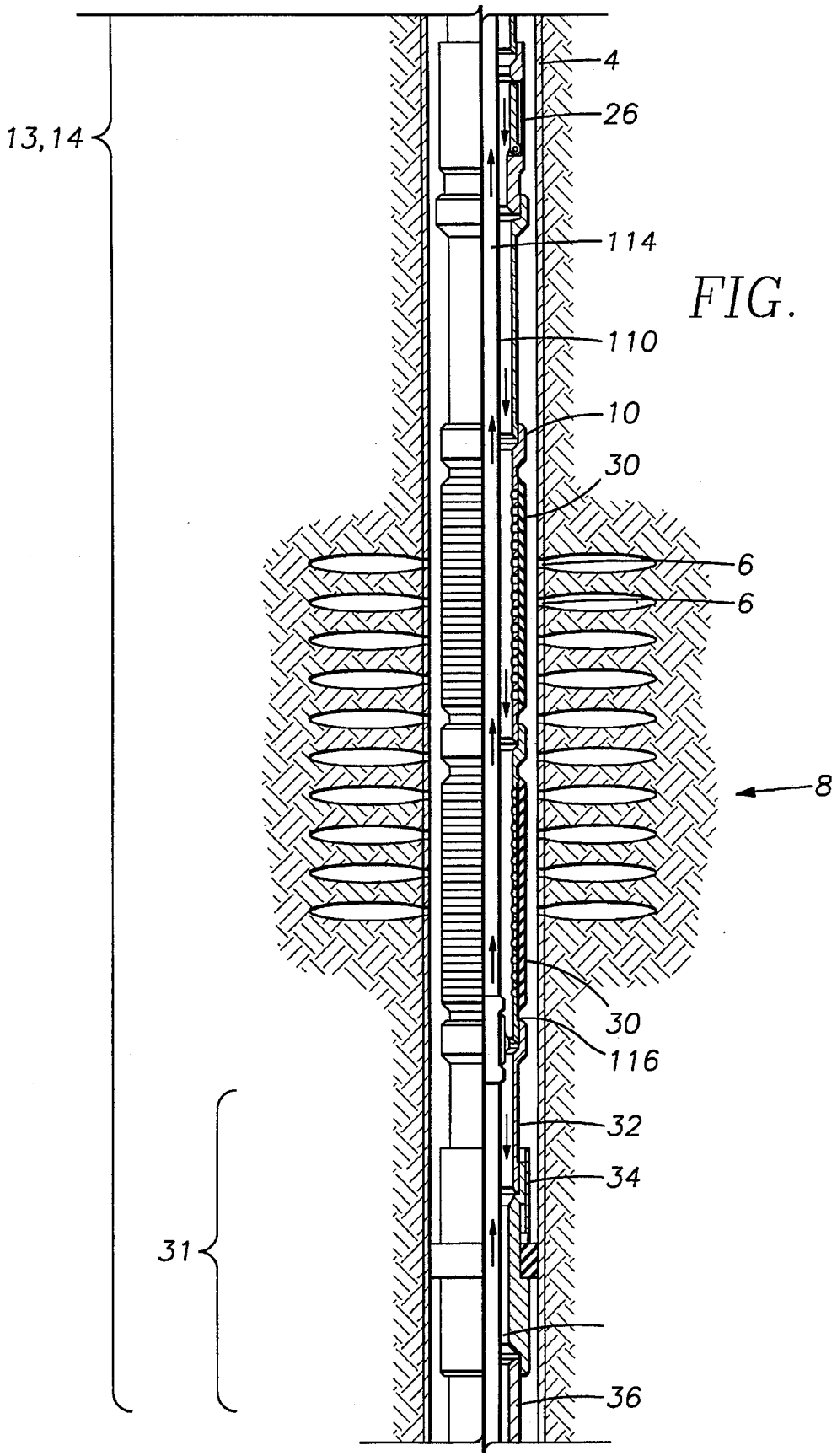
Figure 4C:
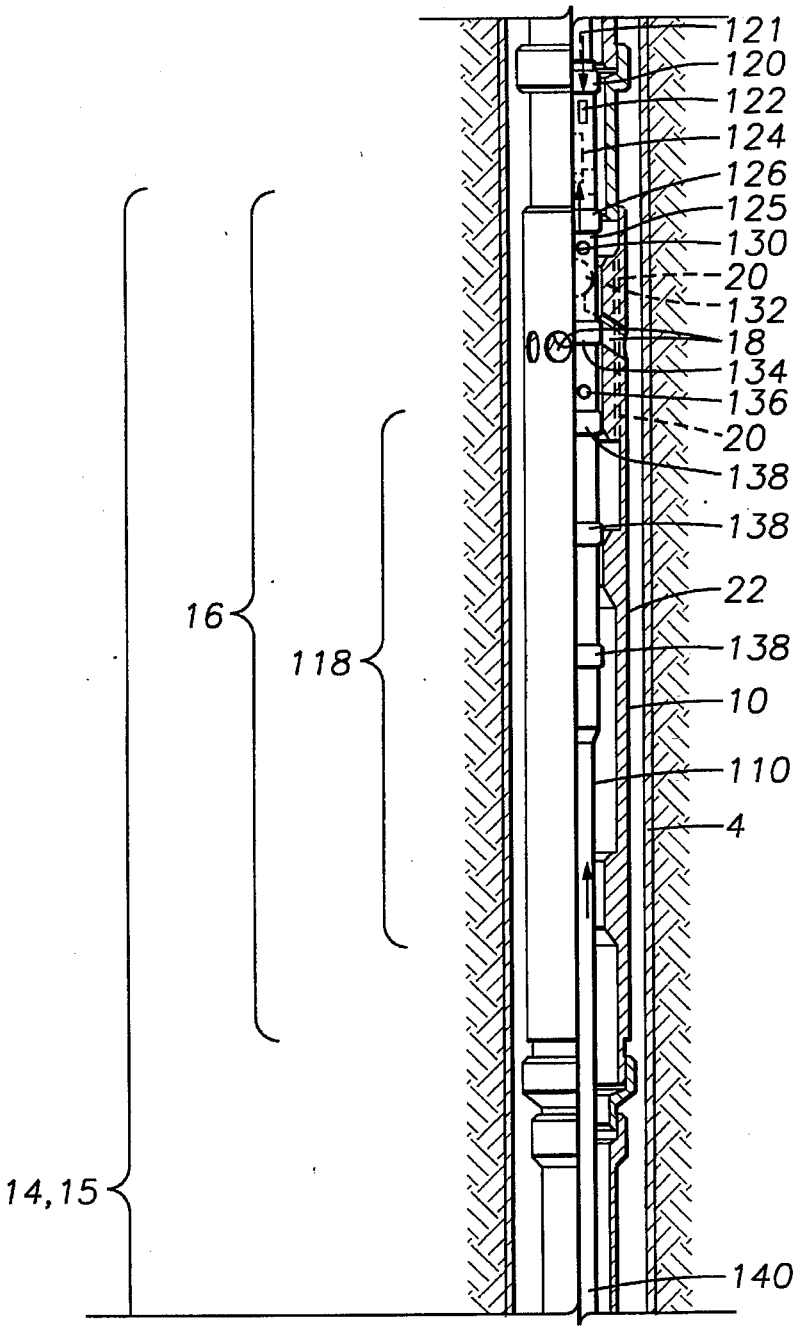
Figure 4D:
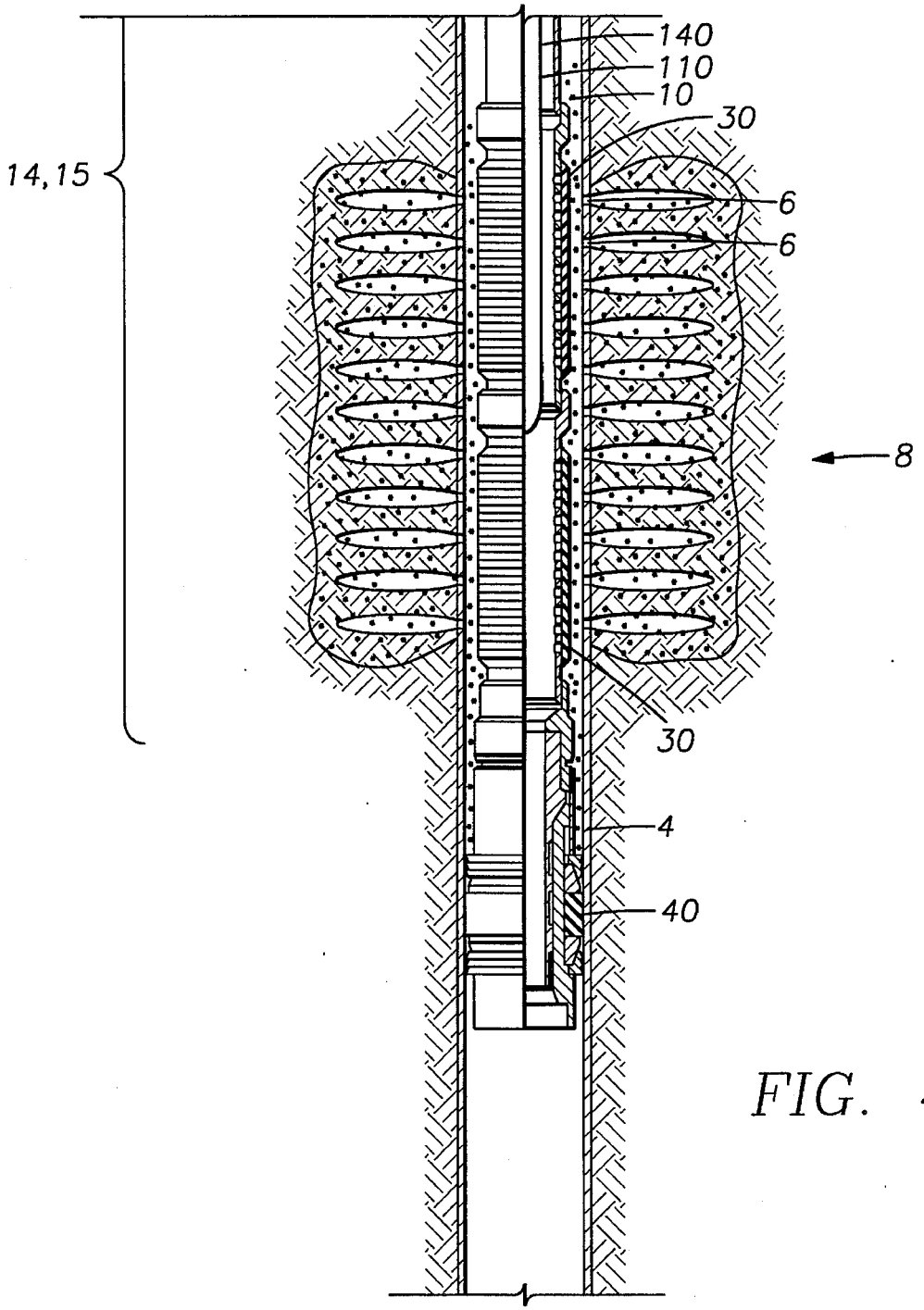
Figure 5A:
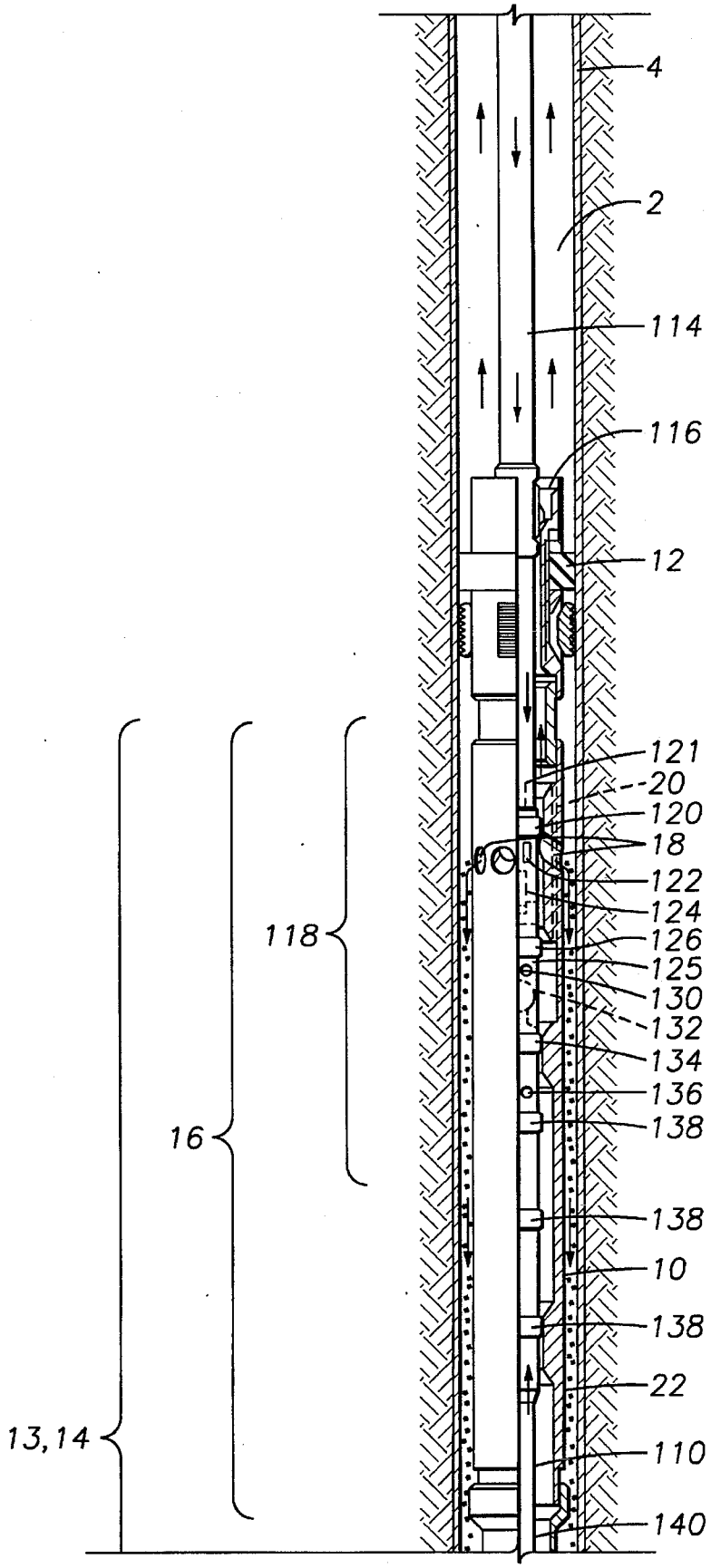
FIG. 5A–D is a partially cut away drawing of the High-Rate Multizone Gravel Pack System, showing the system in position to gravel pack an upper zone.
Figure 5B:
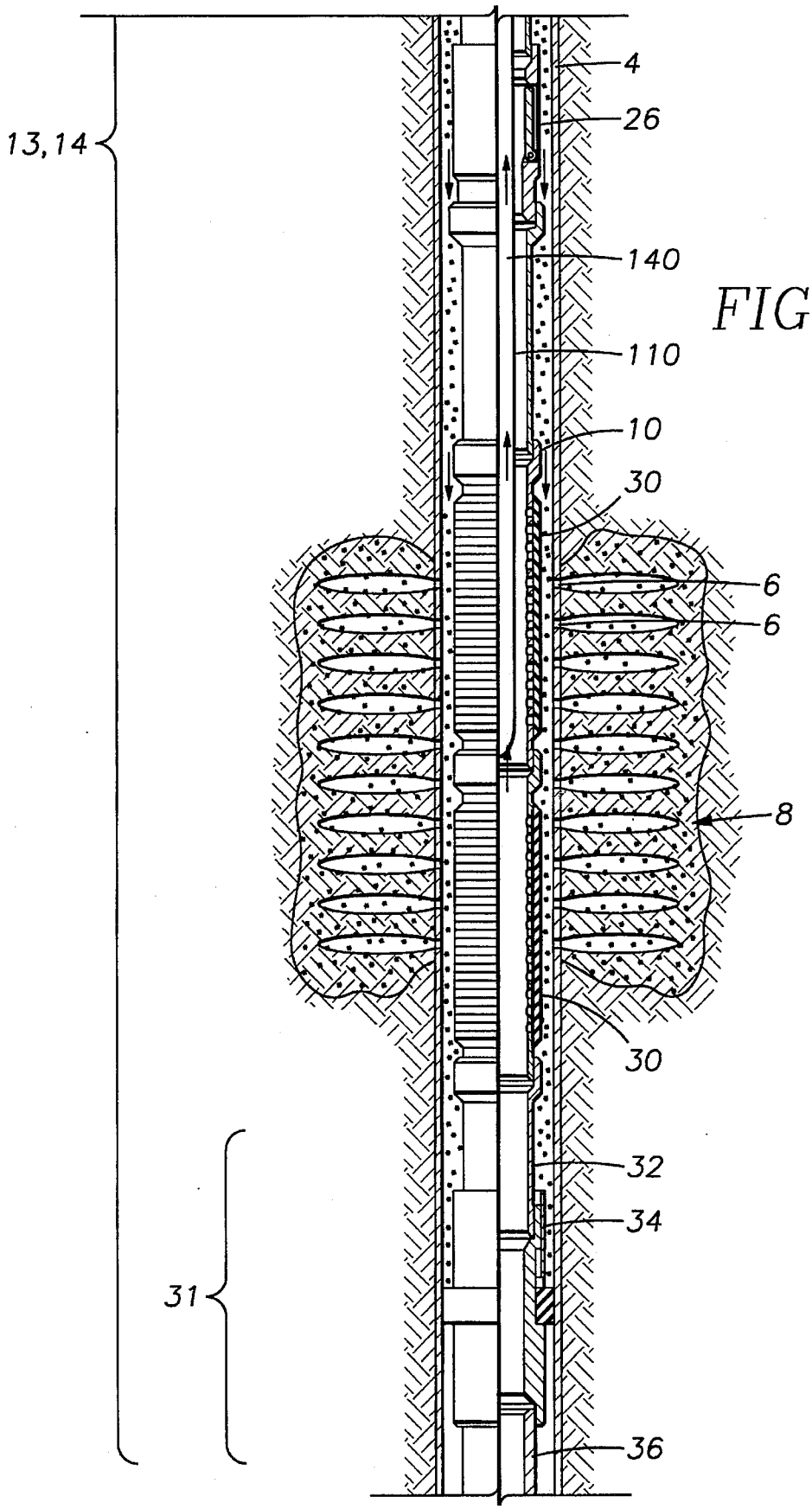
Figure 5C:
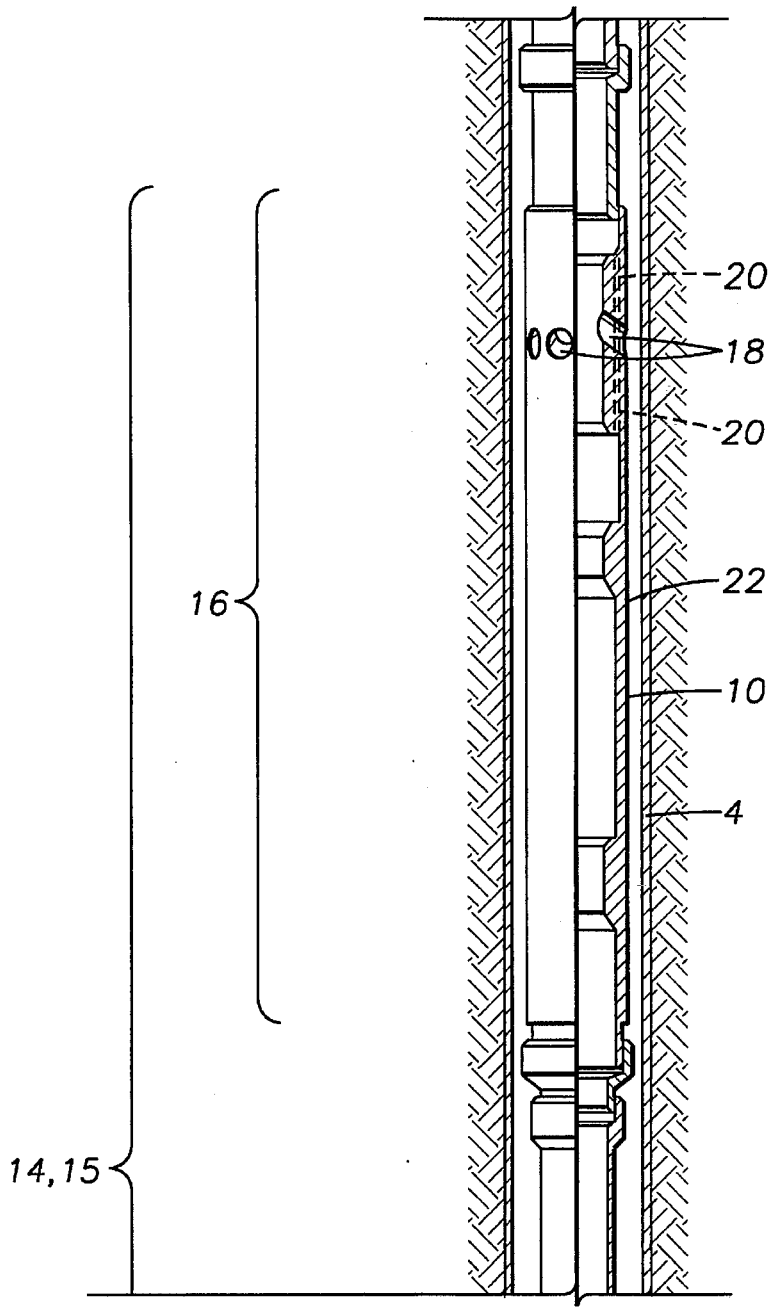
Figure 5D:
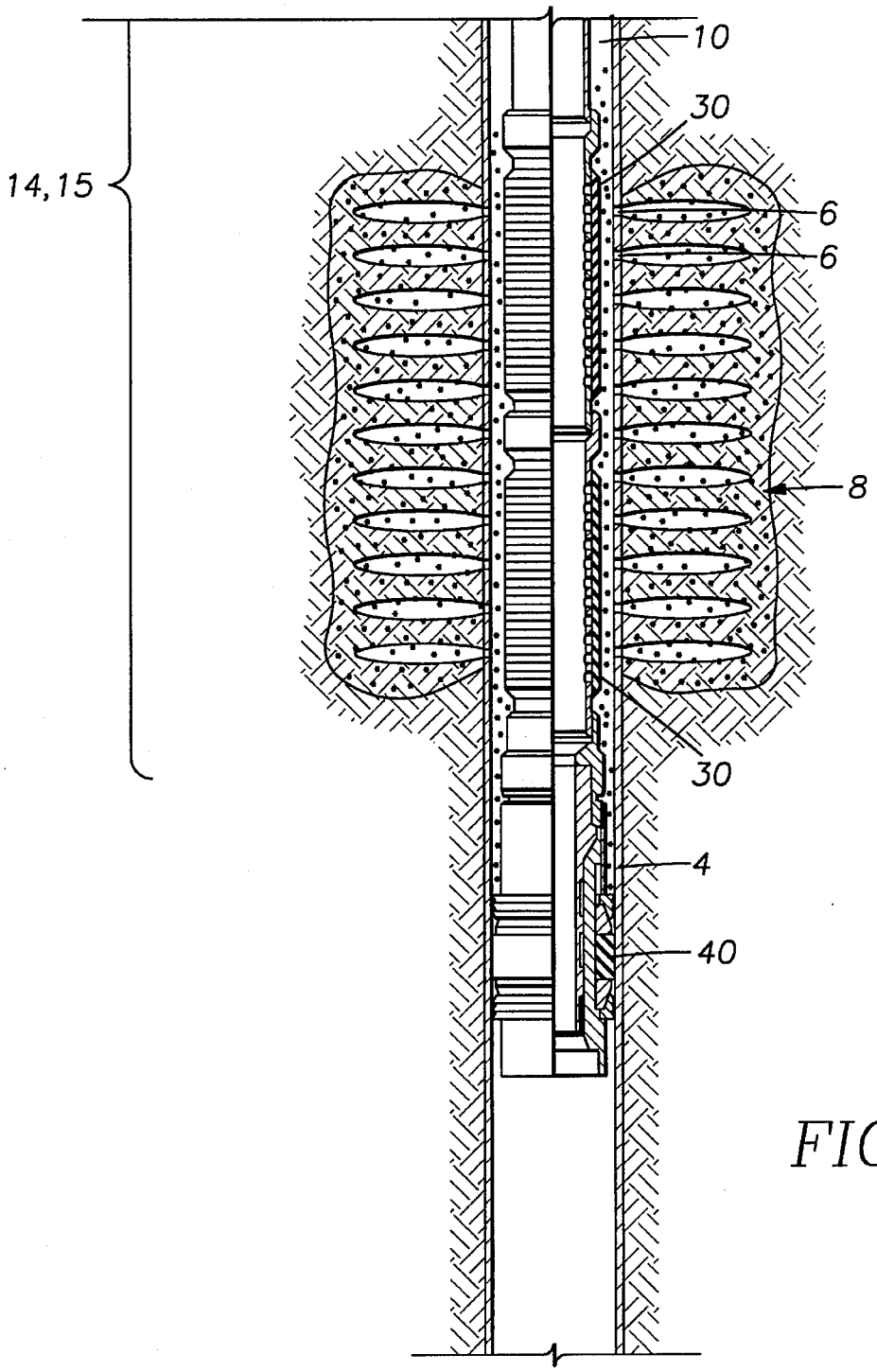
Figure 6A:
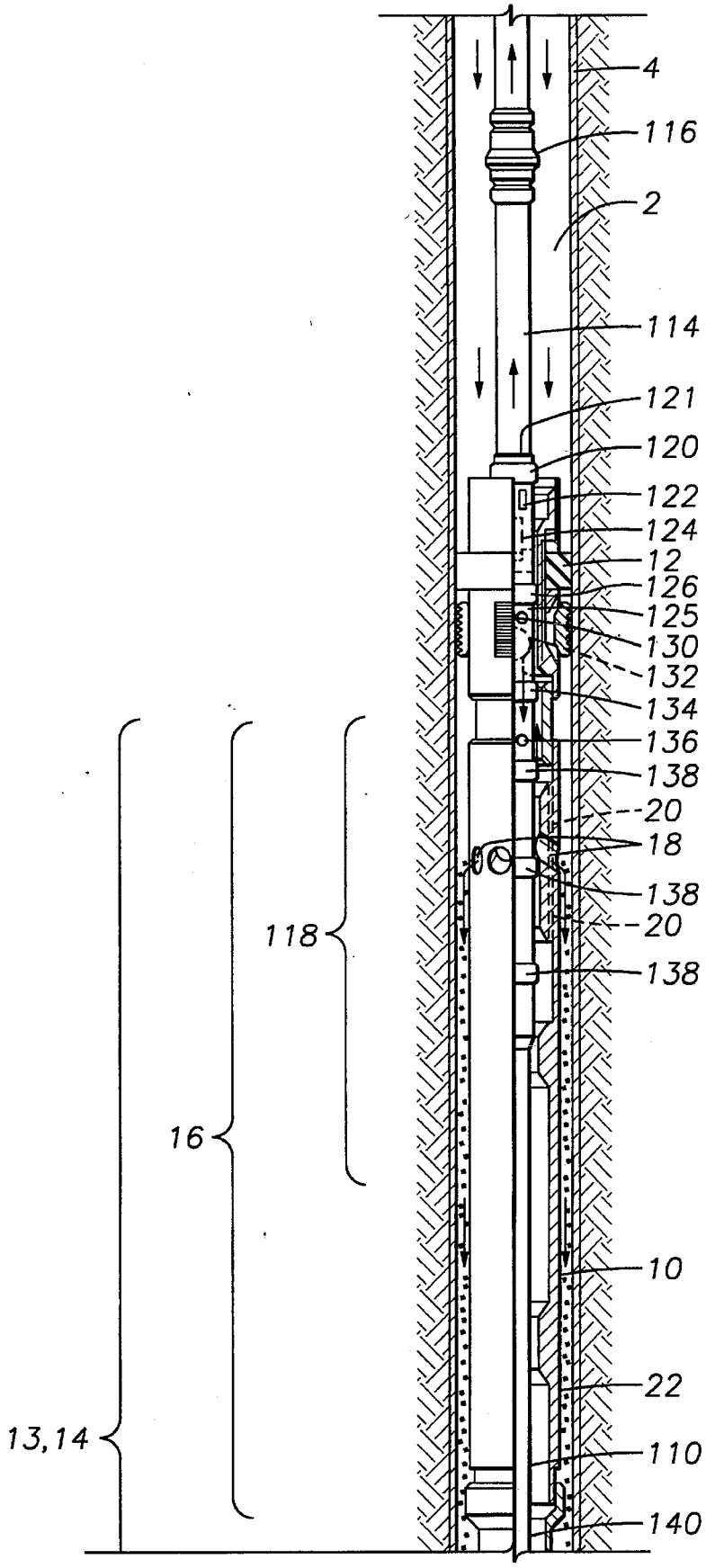
FIG. 6A–D is a partially cut away drawing of the High-Rate Multizone Gravel Pack System, showing the system in position to reverse flow after gravel packing an upper zone.
Figure 6B:
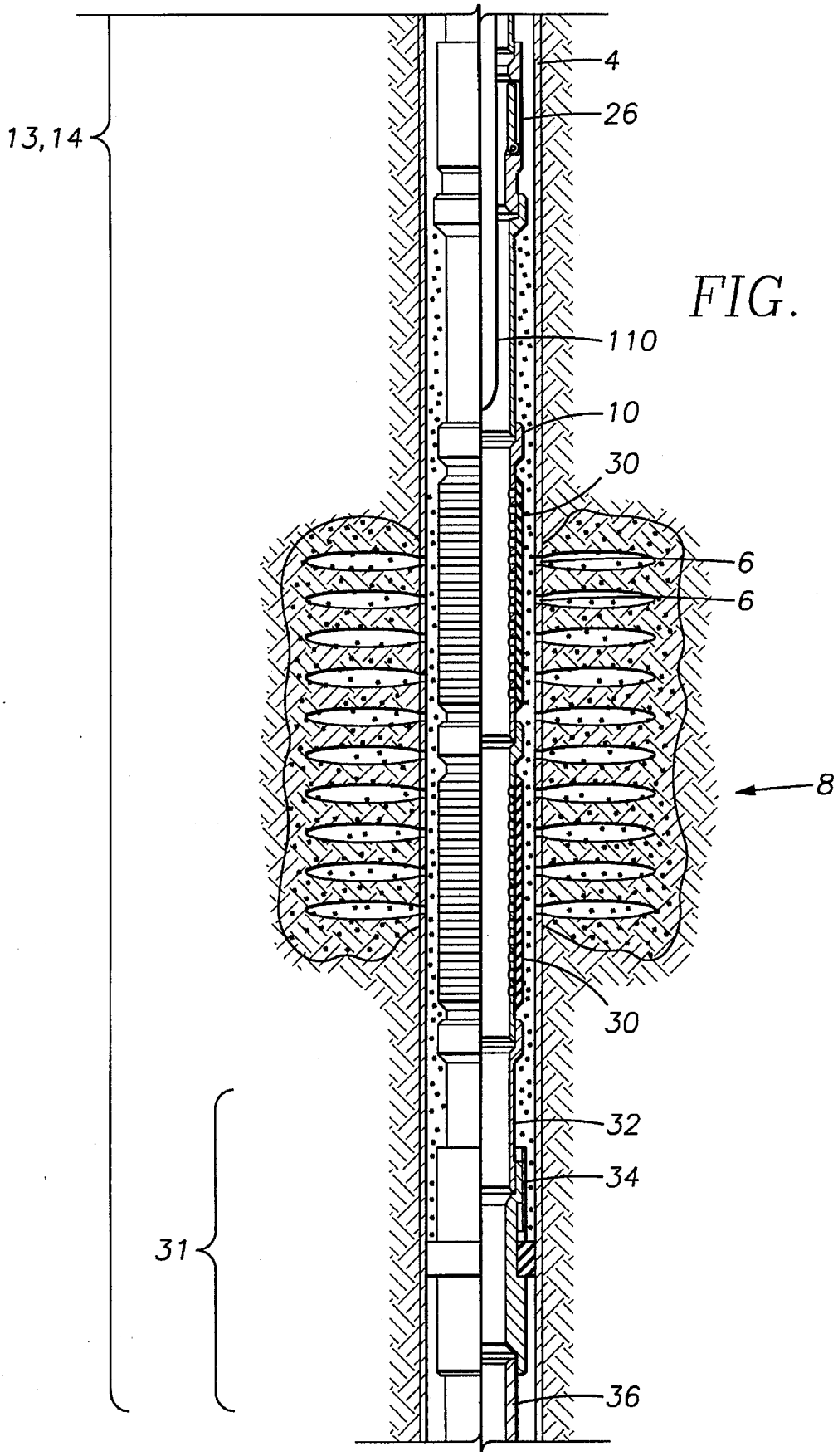
Figure 6C:
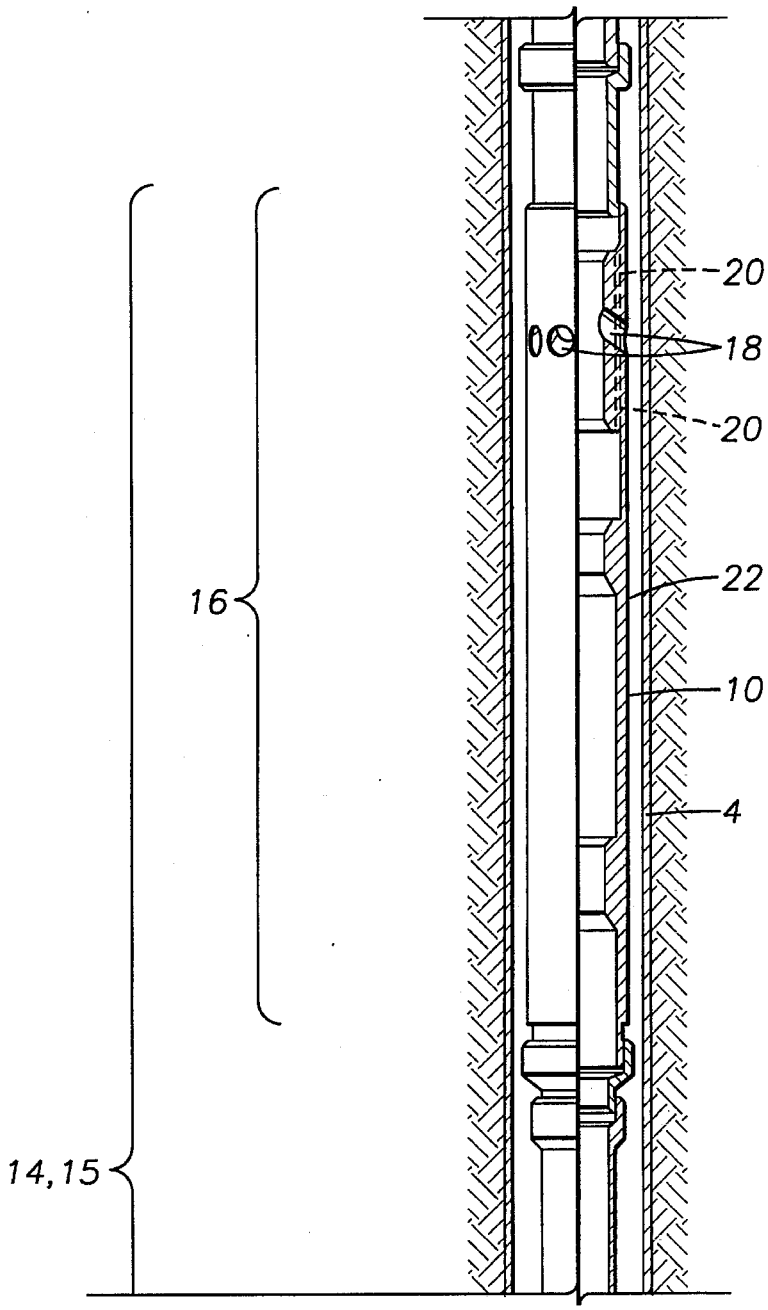
Figure 6D:
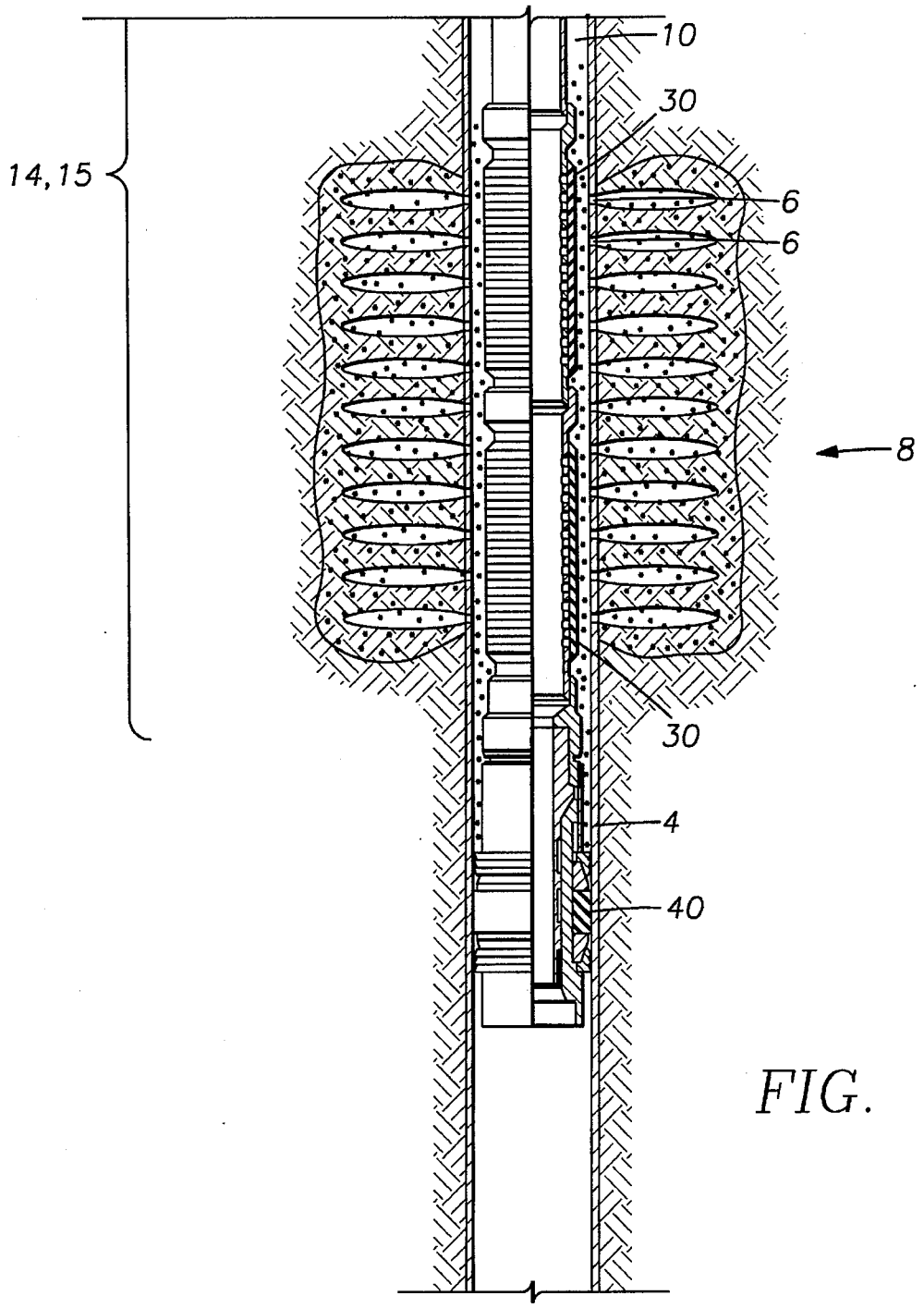

In contrast to the above described configurations, referring to FIG. 2C, a prior art bypass tool is shown. There, the upward-flowing fluid return channels 214 are in the same portion of the tool as the downward-flowing fluid channels 210. This prior art design requires dividing the tool's cross-sectional area between downward- and upward-flowing channels. In the preferred embodiment of the present invention, positioning the return channels 20 in the external bypass subassembly 16 allows greater downward flow area in the internal bypass subassembly 118. Further, in the prior art design shown in FIG. 2C, the downward-flowing fluid pathway 210 requires a series of four right-angle turns 212 to redirect the liquid flow from the interior to the exterior of the tool. This reduced area pathway results in substantially higher pressure losses and greater tool erosion than does the design of the present invention.

Referring again to FIG. 1A–D, one embodiment of the High-Rate Multizone Gravel Pack System is shown in position to wash down a well bore 2. The well bore 2 comprises a casing 4 with perforations 6 into production zones 8. The sump packer 40 is set by conventional methods, either by electric line or mechanical setting tools. The outer equipment string 10 is disconnected from the sump packer 40, and the outer equipment string 10 and the inner equipment string 110 are lowered into position using the setting tool 112. The upper packer 12 and the isolation packers 34 on the circulation stages 14 are not set at this point, providing a fluid flow path in the annulus between the casing 4 and the outer equipment string 10. Fluid is pumped down the inner equipment string 110, passing through the upper wash pipe 114 and into the inner fluid pathway 121 of the internal bypass subassembly 118. The internal by-bass subassembly 118 is positioned so that the first seal ring 120 and the lower seal tings 138 form seals with the bypass extension 22. Fluid flows out of the inner fluid pathway 121 through the first outlet ports 122, through the annulus between the internal bypass subassembly 118 and the bypass extension 22, into the bypass 136, then through the lower wash pipe 140. The fluid exits the bottom of the lower wash pipe 140 and returns to the surface through the annulus between the casing 4 and the outer equipment string 10. The fluid is prevented from flowing upward in the annulus between the outer equipment string 10 and the inner equipment string 110 by the seal formed between the lower seal rings 138 of the internal bypass subassembly 118 and the bypass extension 22.

After the wash-down phase depicted in FIG. 1A–D is completed, the upper packer 12 and each isolation packer 34 are set. The upper packer 12 can be set by the hydraulic setting tool 112. This is usually accomplished by dropping a ball or by pressuring up against the well bore 2. Each isolation packer 34 is set by raising the inner equipment string 110 (using the setting tool 112) into position so that the first seal ring 120 of the internal bypass subassembly 118 forms a seal within the respective upper seal bore 32 in the isolation package 31, and the third seal ring 134 of the internal bypass subassembly 118 forms a seal within the respective lower seal bore 36 in the isolation package 31. Fluid pressure can then be used by pumping fluid through the upper wash pipe 114, the inner fluid pathway 121, and the first outlet ports 122 of the internal bypass subassembly 118 to inflate and set the isolation packer 34.

With the upper packer 12 and isolation packers 34 set, the High-Rate Multizone Gravel Pack System can be used to gravel pack the production zones 8. Referring to Fig. 3A–D and FIG. 5A–D, the inner equipment string 110 is lowered to position in the desired circulation stage 14. The indicating collet 116 identifies the proper position by indicating its contact with the next-higher circulation stage's 14 isolation packer 34, or, in the case of the top-most circulation stage 13, with the upper packer 12. In this position, the internal bypass subassembly 118 is in the same position as is reflected in FIG. 2. In position for gavel packing, the first seal ring 120 of the internal bypass subassembly 118 forms a seal near the top of the external bypass subassembly 16, but below the uppermost openings of the return channels 20. The first outlet ports 122 are aligned with the high-rate exit ports 18. The second seal ting 126 forms a seal with the external bypass subassembly 16 below the high-rate exit ports 18. The second outlet ports 130 are positioned below the lowermost openings of the return channels 20. The third seal ting 134 and the bottom-most of the lower seal tings 138 form seals with the bypass extension 22.

Gravel packing is accomplished by pumping fluid containing the gravel packing material down through the upper wash pipe 114 and into the inner fluid pathway 121 of the internal bypass sub-assembly 118. The fluid exits the inner fluid pathway 121 through the first outlet ports 122 and flows through the high-rate exit ports 18 of the external bypass subassembly 16. The fluid then flows down through the annulus between the outer equipment string 10 and the casing 4 and is forced out of the casing 4 under pressure through the perforations 6 into the formation 8. Fluid is prevented from flowing further down hole by the isolation packer 34 if the gravel packing operation is being carried out at any circulation stage 14 except the bottom-most circulation stage 15, or by the sump packer 40 if the gravel packing is being carried out at the bottom-most circulation stage 15. Fluid is therefore forced to return through the pre-pack screens 30, which filter substantially all remaining gravel-packing material out of the fluid. The fluid flows up through the lower wash pipe 140 into the internal bypass subassembly 118. The fluid flows upwards through the low bottom hole pressure check valve 132, out the second outlet ports 130, and into and through the return channels 20 of the external bypass subassembly 16. After exiting the return channels 20, the fluid continues to flow upward in the annulus between the inner equipment string 110 and the outer equipment string 10.

On completion of the gravel packing operation, the High-Rate Multizone Gravel Pack System can also be configured to reverse flow and remove any excess gravel packing material. Referring to FIG. 4A–D and FIG. 6A–D, two embodiments of the reverse flow position are shown. The inner equipment string 110 is raised so that the third seal ring 134 engages and seals the high-rate exit ports 18 of the circulation stage 14 which was most recently used for gravel packing operations. Fluid is pumped down hole in the annulus between the casing 4 and the inner equipment string 110. The upper packer 12 seals the annulus between the casing 4 and the outer equipment string 10, so that the fluid flows into the annulus between the inner equipment string 110 and the outer equipment string 10. The fluid is prevented from flowing beyond the third seal ring 134, and is forced into the inner equipment string 110 through the first outlet ports 122. The fluid then flows into and through the upper wash pipe 114 to return to the surface.

The above steps can be repeated for each circulation stage 14 which is placed in the well bore 2 by repositioning the inner equipment string 110, so that each production zone 8 may be gravel packed with a single trip of the inner equipment string 110 into the well bore 2. When the last production zone 8 is gravel packed and the inner equipment string 110 is lifted out of the well bore 2, the knock-out isolation valve 26 in the upper-most circulation stage 14 closes, preventing the backwash of fluid from the inner equipment string 110 into the circulation stages 14.

At all times during these procedures, the memory gauge/landing assembly 124 records the formation pressure and temperature in the lower wash pipe 140 by means of probe 125. The probe 125 is place in a still location to sense formation pressure without interference from flowing liquid. This memory gauge/landing assembly 124 can be retrieved and re-inserted into the internal bypass subassembly 118 at any time during the procedures. When the memory gauge/landing assembly 124 is retrieved, the data stored therein can be downloaded to a computer system for analysis of downhole conditions.

Many modifications and variations may be made in the embodiments described herein and depicted in the accompanying drawings without departing from the concept of the present invention. Accordingly, it is understood that the embodiments described and illustrated herein are illustrative only and are not intended as a limitation upon the scope of this invention.

We claim:

1. A method of gravel packing a formation comprising the steps of:

inserting a bypass tool having an exterior and comprising an internal bypass subassembly and an external bypass subassembly into a well bore, wherein said internal bypass subassembly comprises an inner fluid pathway;

pumping gravel-bearing fluid into said inner fluid pathway;

diverting said gravel-bearing fluid from said inner fluid pathway to the exterior of said bypass tool through a passage in said external bypass subassembly and toward the formation by deflecting the direction of the entirety of the flow of said gravel-bearing fluid through said passage less than four times;

depositing gravel from said gravel-bearing fluid into a formation; and returning said fluid to the surface.

2. The method of gravel packing a formation of claim 1, wherein said step of diverting said gravel-bearing fluid as it flows through said passage is accomplished by deflecting the direction of flow of said gravel-bearing fluid no more than two times.

3. The method of gravel packing a formation of claim 2, wherein said external bypass subassembly comprises at least one return channel, and wherein said step of returning said fluid to the surface is accomplished by routing said fluid through said return channel.

4. The method of gravel packing a formation of claim 2, additionally comprising the steps of:

recording the fluid temperature and/or the formation pressure; and retrieving the recorded temperature and/or pressure information at the surface.

5. The method of gravel packing a formation of claim 2, wherein said inner fluid pathway has a cross-sectional area at least forty percent as large as the total cross-sectional area of said internal bypass subassembly.

6. The method of gravel packing a formation of claim 1, wherein said external bypass subassembly comprises at least one return channel, and wherein said step of returning said fluid to the surface is accomplished by routing said fluid through said return channel.

7. The method of gravel packing a formation of claim 1, additionally comprising the steps of:

recording the fluid temperature and/or the formation pressure; and retrieving the recorded temperature and/or pressure information at the surface.

8. The method of gravel packing a formation of claim 1, wherein said inner fluid pathway has a cross-sectional area at least forty percent as large as the total cross-sectional area of said internal bypass subassembly.

9. A method of gravel packing a formation comprising the steps of:

inserting a bypass tool having an exterior and comprising an internal bypass subassembly and an external bypass subassembly into a well bore, wherein said internal bypass subassembly comprises an inner fluid pathway;

pumping gravel-bearing fluid into said inner fluid pathway;

diverting said gravel-bearing fluid from said inner fluid pathway to the exterior of said bypass tool through a passage in said external bypass subassembly and toward the formation by deflecting the direction of flow of said gravel-bearing fluid through said passage less than four times;

depositing gravel from said gravel-bearing fluid into a formation; and returning said fluid to the surface;

moving said internal bypass subassembly relative to said external bypass subassembly subsequent to said depositing step, wherein said movement of said internal bypass subassembly precludes fluid communication between said inner fluid pathway and the exterior of said external bypass subassembly said internal and external bypass subassemblies providing a flow path therebetween;

providing fluid communication from said inner fluid pathway to said flowpath;

pumping fluid through a circuit comprising said flowpath, said inner fluid pathway and said washpipe; and removing excess gravel from the well bore.

10. The method of gravel packing a formation of claim 9, additionally comprising the steps of:

repeatedly altering the position of said internal bypass subassembly with respect to said external bypass subassembly within the well bore without removal of said internal bypass subassembly from the well bore; and facilitating successive gravel packing at least one additional portion of the formation within the well bore by virtue of said repeated alterations of the relative position of said internal bypass subassembly with respect to said external bypass subassembly.

11. The method of gravel packing a formation of claims 10, additionally comprising the step of:

isolating previously packed portions of the formation from fluid flow used to pack other portions of the formation.

12. A method of gravel packing a formation comprising the steps of:

inserting a bypass tool having an exterior and comprising an internal bypass subassembly and an external bypass subassembly into a well bore, wherein said internal bypass subassembly comprises an inner fluid pathway;

pumping gravel-bearing fluid into said inner fluid pathway;

diverting said gravel-bearing fluid from said inner fluid pathway to the exterior of said bypass tool through a passage in said external bypass subassembly and toward the formation by deflecting the direction of flow of said gravel-bearing fluid through said passage no more than two times;

depositing gravel from said gravel-bearing fluid into a formation; and returning said fluid to the surface;

moving said internal bypass subassembly relative to said external bypass subassembly subsequent to said depositing step, wherein said movement of said internal bypass subassembly precludes fluid communication between said inner fluid pathway and the exterior of said external bypass subassembly said internal and external bypass subassemblies providing a flow path therebetween;

providing fluid communication from said inner fluid pathway to said flowpath;

pumping fluid through a circuit comprising said flowpath, said inner fluid pathway and said washpipe; and removing excess gravel from the well bore.

13. The method of gravel packing a formation of claim 12, additionally comprising the steps of:

repeatedly altering the position of said internal bypass subassembly with respect to said external bypass subassembly within the well bore without removal of said internal bypass subassembly from the well bore; and facilitating successive gravel packing at least one additional portion of the formation within the well bore by virtue of said repeated alterations of the relative position of said internal bypass subassembly with respect to said external bypass subassembly.

14. The method of gravel packing a formation of claim 13, additionally comprising the step of:

isolating previously packed portions of the formation from fluid flow used to pack other portions of the formation.

15. A method of gravel packing a formation comprising the steps of:

inserting a bypass tool having an exterior and comprising an internal bypass subassembly and an external bypass subassembly into a well bore, wherein said internal bypass subassembly comprises an inner fluid pathway;

pumping gravel-bearing fluid into said inner fluid pathway;

diverting said gravel-bearing fluid from said inner fluid pathway to the exterior of said bypass tool through a passage in said external bypass subassembly and toward the formation by deflecting the direction of flow of said gravel-bearing fluid through said passage not more than two times;

depositing gravel from said gravel-bearing fluid into a formation; and returning said fluid to the surface;

said external bypass subassembly comprises at least one return channel, and wherein said step of returning said fluid to the surface is accomplished by routing said fluid through said return channel;

moving said internal bypass subassembly relative to said external bypass subassembly subsequent to said depositing step, wherein said movement of said internal bypass subassembly precludes fluid communication between said inner fluid pathway and the exterior of said external bypass subassembly said internal and external bypass subassemblies providing a flow path therebetween;

providing fluid communication from said inner fluid pathway to said flowpath;

pumping fluid through a circuit comprising said flowpath, said inner fluid pathway and said washpipe; and removing excess gravel from the well bore.

16. The method of gravel packing a formation of claim 15, additionally comprising the steps of:

repeated altering the position of said internal bypass subassembly with respect to said external bypass subassembly within the well bore without removal of said internal bypass subassembly from the well bore; and facilitating successive gravel packing at least one additional portion of the formation within the well bore by virtue of said repeated alterations of the relative position of said internal bypass subassembly with respect to said external bypass subassembly.

17. The method of gravel packing a formation of claim 16, additionally comprising the step of:

protecting all sections of the well bore containing previously packed formations from fluid flow resulting from additional formation packing isolating previously packed portions of the formation from fluid flow used to pack other portions of the formation.

18. The method of gravel packing a formation of claim 17, additionally comprising the steps of:

recording the fluid temperature and/or the formation pressure; and retrieving the recorded temperature and/or pressure information at the surface.

19. The method of gravel packing a formation of claim 18, wherein said inner fluid pathway has a cross-sectional area at least forty percent as large as the total cross-sectional area of said internal bypass subassembly.

20. A gravel packing apparatus for directing fluid flow from the surface to deposit gravel therewith into a well bore comprising:

an internal bypass subassembly and an outer equipment string, said internal bypass subassembly comprising an inner fluid pathway and at least one outlet port, said outer equipment string comprising a first external bypass subassembly, and said first external bypass subassembly comprising at least a first exit passage;

wherein said internal bypass subassembly and said first external bypass subassembly are alignable to provide fluid communication from said inner fluid pathway through said outlet port and said first exit passage to the exterior of said external bypass subassembly; and said first exit passage is capable of deflecting the entirety of the fluid from said inner fluid pathway to the exterior of said first external bypass subassembly through fewer than four deflections.

21. The apparatus of claim 20, wherein said first exit passage deflects the fluid flow no more than twice.

22. The apparatus of claim 21, wherein said first external bypass subassembly additionally comprises at least a first return channel providing a fluid pathway for returning fluid moving back toward the surface after depositing the gravel.

23. The apparatus of claim 21, wherein said internal bypass subassembly additionally comprises:

a plurality of seals mounted on said internal bypass subassembly selectively positionable against the interior of said first external bypass subassembly, to selectively allow or prevent fluid flow through said first exit passage.

24. The apparatus of claim 21 wherein said inner fluid pathway has a cross-sectional area of at least at least forty percent as large as the total cross-sectional area of said first internal bypass subassembly.

25. The apparatus of claim 20, wherein said first external bypass subassembly additionally comprises at least a first return channel providing a fluid pathway for returning fluid moving back toward the surface after depositing the gavel.

26. The apparatus of claim 20, wherein said internal bypass subassembly additionally comprises:

a plurality of seals mounted on said internal bypass subassembly selectively positionable against the interior of said first external bypass subassembly, to selectively allow or prevent fluid flow through said first exit passage.

27. The apparatus of claim 20 wherein said inner fluid pathway has a cross-sectional area of at least at least forty percent as large as the total cross-sectional area of said first internal bypass subassembly.

28. A gravel packing apparatus for directing fluid flow from the surface to deposit gravel therewith into a well bore comprising:

an internal bypass subassembly and an outer equipment string, said internal bypass subassembly comprising an inner fluid pathway and at least one outlet port, said outer equipment string comprising a first external bypass subassembly, and said first external bypass subassembly comprising at least a first exit passage;

wherein said internal bypass subassembly and said first external bypass subassembly are alignable to provide fluid communication from said inner fluid pathway through said outlet port and said first exit passage to the exterior of said external bypass subassembly; and said first exit passage is capable of deflecting fluid from said inner fluid pathway to the exterior of said first external bypass subassembly through fewer than four deflections;

said internal bypass subassembly additionally comprises a memory gauge/landing module capable of recording the formation pressure and/or the fluid temperature.

29. The apparatus of claim 28 wherein said memory gauge/landing module is retrievable to the surface without removing said internal bypass subassembly from the well bore.

30. A gravel packing apparatus for directing fluid flow from the surface to deposit gravel therewith into a well bore comprising:

an internal bypass subassembly and an outer equipment string, said internal bypass subassembly comprising an inner fluid pathway and at least one outlet port, said outer equipment string comprising a first external bypass subassembly, and said first external bypass subassembly comprising at least a first exit passage;

wherein said internal bypass subassembly and said first external bypass subassembly are alignable to provide fluid communication from said inner fluid pathway through said outlet port and said first exit passage to the exterior of said external bypass subassembly; and said first exit passage is capable of deflecting fluid from said inner fluid pathway to the exterior of said first external bypass subassembly through no more than two deflections;

said internal bypass subassembly additionally comprises a memory gauge/landing module capable of recording the formation pressure and/or the fluid temperature.

31. The apparatus of claim 30 wherein said memory gauge/landing module is retrievable to the surface without removing said internal bypass subassembly from the well bore.

32. A gravel packing apparatus for directing fluid flow from the surface to deposit gravel therewith into a well bore comprising;

an internal bypass subassembly and an outer equipment string, said internal bypass subassembly comprising an inner fluid pathway and at least one outlet port, said outer equipment string comprising a first external bypass subassembly, and said first external bypass subassembly comprising at least a first exit passage;

wherein said internal bypass subassembly and said first external bypass subassembly are alignable to provide fluid communication from said inner fluid pathway through said outlet port and said first exit passage to the exterior of said external bypass subassembly; and said first exit passage is capable of deflecting the fluid from said inner fluid pathway to the exterior of said first external bypass subassembly through fewer than four deflections;

said outer equipment string further comprises at least a second external bypass subassembly, wherein said second external bypass subassembly comprises at least a second exit passage and wherein said internal bypass subassembly may be aligned with said second external bypass subassembly to provide fluid communication from said inter fluid pathway through said outlet prot and said second exit passage to the exterior of said second external bypass subassembly, and wherein said second exit passage is capable of deflecting fluid from said inner fluid pathway to the exterior of said second external bypass subassembly through fewer than four deflections; and at least one isolation packer mounted to said outer equipment string, wherein said isolation packer prevents fluid flow external to said outer equipment string from adjacent said second external bypass subassembly to sand adjacent said first external bypass subassembly.

33. The apparatus of claim 32, wherein said second exit passage deflects the fluid flow no more than twice.

34. The apparatus of claim 33, wherein said second external bypass subassembly additionally comprises at least a second return channel providing a fluid pathway for fluid returning toward the surface.

35. The apparatus of claim 34, wherein said internal bypass subassembly additionally comprises:

a plurality of seals mounted on said internal bypass subassembly selectively positionable against the interior or said first external bypass subassembly, to selectively allow or prevent fluid flow through said first exit passage.

36. The apparatus of claim 35 wherein said internal bypass subassembly additionally comprises a memory gauge/landing module capable of recording the formation pressure and/or the fluid temperature.

37. The apparatus of claim 36 wherein said memory gauge/landing module is retrievable to the surface without removing said internal bypass subassembly from the well bore.

38. The apparatus of claim 37 wherein said inner fluid pathway has a cross-sectional area of at least at least forty percent as large as the total cross-sectional area of said first internal bypass subassembly.

39. The apparatus of claim 32, wherein said second external bypass subassembly additionally comprises at least a second return channel providing a fluid pathway for fluid returning toward the surface.

40. The apparatus of claim 32, wherein said internal bypass subassembly additionally comprises:

a plurality of seals mounted on said internal bypass subassembly selectively positionable against the interior of said second external bypass subassembly, to selectively allow or prevent fluid flow through said second exit passage.

41. The apparatus of claim 40 wherein said internal bypass subassembly additionally comprises a memory gauge/landing module capable of recording the formation pressure and/or the fluid temperature.

42. The apparatus of claim 41 wherein said memory gauge/landing module is retrievable to the surface without removing said internal bypass subassembly from the well bore.

43. The apparatus of claim 42 wherein said inner fluid pathway has a cross-sectional area of at least at least forty percent as large as the total cross-sectional area of said second internal bypass subassembly.

* * * * *